US008025388B2

(12) United States Patent
Kadomatsu et al.

(10) Patent No.: US 8,025,388 B2
(45) Date of Patent: Sep. 27, 2011

(54) IMAGE FORMING APPARATUS AND IMAGE FORMING METHOD WITH DECREASED IMAGE TRANSFER DISTURBANCE

(75) Inventors: Tetsuzo Kadomatsu, Kanagawa-ken (JP); Yutaka Maeno, Kanagawa-ken (JP); Toshiyuki Makuta, Fujinomiya (JP); Tsutomu Umebayashi, Fujinomiya (JP); Masaaki Konno, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 1252 days.

(21) Appl. No.: 11/700,195

(22) Filed: Jan. 31, 2007

(65) Prior Publication Data

US 2007/0176995 A1 Aug. 2, 2007

(30) Foreign Application Priority Data

Feb. 1, 2006 (JP) ..... 2006-024849

(51) Int. Cl.
*B41J 2/01* (2006.01)

(52) U.S. Cl. ..... 347/103

(58) Field of Classification Search ..... 347/103, 347/15, 102, 100; 156/240; 399/239; 101/401.1; 106/31.6

See application file for complete search history.

(56) References Cited

U.S. PATENT DOCUMENTS

| | | | | |
|---|---|---|---|---|
| 4,135,960 | A * | 1/1979 | Shuppert et al. | 156/240 |
| 6,029,036 | A * | 2/2000 | Itaya et al. | 399/239 |
| 6,318,853 | B1 * | 11/2001 | Asano et al. | 347/103 |
| 2001/0045175 | A1 * | 11/2001 | Ouchi et al. | 106/31.6 |
| 2002/0085054 | A1 * | 7/2002 | Tokie | 347/15 |
| 2004/0129158 | A1 * | 7/2004 | Figov et al. | 101/401.1 |
| 2005/0270351 | A1 * | 12/2005 | Mouri et al. | 347/103 |
| 2006/0119686 | A1 * | 6/2006 | Odell | 347/102 |
| 2007/0103527 | A1 * | 5/2007 | Satoh | 347/100 |

FOREIGN PATENT DOCUMENTS

| | | | |
|---|---|---|---|
| JP | 10-250052 | A | 9/1998 |
| JP | 10250052 | * | 9/1998 |
| JP | 2000-034432 | A | 2/2000 |
| JP | 2000-044855 | A | 2/2000 |
| JP | 2001-179960 | A | 7/2001 |
| JP | 2005-153368 | A | 6/2005 |
| JP | 2005-161603 | A | 6/2005 |
| JP | 2005161603 | * | 6/2005 |
| JP | 2005-343049 | A | 12/2005 |

OTHER PUBLICATIONS

"Theory behind the bubble pressure method," Kruss, Theory Measuring Techniques, Germany.

Japanese Notice of Reasons for Rejection for corresponding Japanese Application No. 2007-023472, dated Jul. 29, 2011.

* cited by examiner

*Primary Examiner* — Stephen D Meier
*Assistant Examiner* — Carlos A Martinez, Jr.
(74) *Attorney, Agent, or Firm* — Birch, Stewart, Kolasch & Birch, LLP

(57) ABSTRACT

The image forming apparatus includes: an intermediate transfer body; a liquid adhesion device which provides a first liquid having a viscosity not less than 15 mPa·s and not greater than 300 mPa·s at 25° C, on the intermediate transfer body; a droplet ejection device which ejects a second liquid containing a coloring material onto a region of the intermediate transfer body where the first liquid is provided by the liquid adhesion device, in a state where the first liquid on the intermediate transfer body has a thickness not less than 1.6 μm; a viscosity raising device which raises a viscosity of the second liquid on the intermediate transfer body; and a transfer device which transfers an image including dots of the second liquid formed on the intermediate transfer body, onto a recording medium.

13 Claims, 15 Drawing Sheets

FIG.8

| | THICKNESS OF TREATMENT LIQUID (μm) | VISCOSITY OF TREATMENT LIQUID (mPa·sec) | DYNAMIC SURFACE TENSION OF TREATMENT LIQUID γ1 (0.1 sec) (mN/m) | DYNAMIC SURFACE TENSION OF INK γ2 (0.1 sec) (mN/m) | TREATMENT LIQUID | INK | GRAININESS | JUDGMENT |
|---|---|---|---|---|---|---|---|---|
| COMPARATIVE EXAMPLE | NONE | – | – | 34.8 | – | 201 | 1.6 | VERY POOR |
| | NONE | – | – | 31.3 | – | 202 | 1.7 | POOR |
| | 1.4 | 15.3 | 31 | 34.8 | 101 | 201 | 0.81 | POOR |
| | 1.4 | 15.3 | 31 | 31.3 | 101 | 202 | 0.65 | POOR |
| | 1.5 | 15.3 | 31 | 34.8 | 101 | 201 | 0.62 | POOR |
| | 1.5 | 15.3 | 31 | 31.3 | 101 | 202 | 0.59 | FAIR |
| THE PRESENT INVENTION | 1.6 | 15.3 | 31 | 34.8 | 101 | 201 | 0.42 | GOOD |
| | 1.6 | 15.3 | 31 | 31.3 | 101 | 202 | 0.48 | GOOD |
| | 2 | 15.3 | 31 | 34.8 | 101 | 201 | 0.39 | GOOD |
| | 2 | 15.3 | 31 | 31.3 | 101 | 202 | 0.39 | GOOD |
| | 5 | 15.3 | 31 | 34.8 | 101 | 201 | 0.35 | GOOD |
| | 5 | 15.3 | 31 | 31.3 | 101 | 202 | 0.39 | GOOD |
| | 10 | 15.3 | 31 | 34.8 | 101 | 201 | 0.22 | VERY GOOD |
| | 10 | 15.3 | 31 | 31.3 | 101 | 202 | 0.22 | VERY GOOD |

FIG.9

| | THICKNESS OF TREATMENT LIQUID (μm) | VISCOSITY OF TREATMENT LIQUID (mPa·sec) | DYNAMIC SURFACE TENSION OF TREATMENT LIQUID γ1 (0.1 sec) (mN/m) | DYNAMIC SURFACE TENSION OF INK γ2 (0.1 sec) (mN/m) | TREATMENT LIQUID | INK | GRAININESS | JUDGMENT |
|---|---|---|---|---|---|---|---|---|
| COMPARATIVE EXAMPLE | 10 | 482 | 30.5 | 34.8 | 102 | 201 | 0.81 | POOR |
| | 10 | 482 | 30.5 | 31.3 | 102 | 202 | 0.76 | POOR |
| | 10 | 310 | 31.2 | 34.8 | 103 | 201 | 0.75 | POOR |
| | 10 | 310 | 31.2 | 31.3 | 103 | 202 | 0.67 | FAIR |
| THE PRESENT INVENTION | 10 | 287 | 31.4 | 34.8 | 104 | 201 | 0.46 | GOOD |
| | 10 | 287 | 31.4 | 31.3 | 104 | 202 | 0.48 | GOOD |
| | 10 | 48 | 30.8 | 34.8 | 105 | 201 | 0.38 | GOOD |
| | 10 | 48 | 30.8 | 31.3 | 105 | 202 | 0.39 | GOOD |
| | 10 | 15.3 | 31 | 34.8 | 101 | 201 | 0.22 | VERY GOOD |
| | 10 | 15.3 | 31 | 31.3 | 101 | 202 | 0.29 | VERY GOOD |

FIG.10

| | THICKNESS OF TREATMENT LIQUID (μm) | VISCOSITY OF TREATMENT LIQUID (mPa·sec) | DYNAMIC SURFACE TENSION OF TREATMENT LIQUID γ1 (0.1 sec) (mN/m) | DYNAMIC SURFACE TENSION OF INK γ2 (0.1 sec) (mN/m) | TREATMENT LIQUID | INK | GRAININESS | JUDGMENT |
|---|---|---|---|---|---|---|---|---|
| THE PRESENT INVENTION | 10 | 15.2 | 35 | 34.8 | 106 | 201 | 0.41 | GOOD |
| | 10 | 15.2 | 35 | 32.9 | 106 | 203 | 0.45 | GOOD |
| | 10 | 15.2 | 35 | 31.3 | 106 | 202 | 0.48 | GOOD |
| | 10 | 15 | 33 | 34.8 | 107 | 201 | 0.27 | VERY GOOD |
| | 10 | 15 | 33 | 32.9 | 107 | 203 | 0.42 | GOOD |
| | 10 | 15 | 33 | 31.3 | 107 | 202 | 0.45 | GOOD |
| | 10 | 15.3 | 31 | 34.8 | 101 | 201 | 0.22 | VERY GOOD |
| | 10 | 15.3 | 31 | 32.9 | 101 | 203 | 0.28 | VERY GOOD |
| | 10 | 15.3 | 31 | 31.3 | 101 | 202 | 0.29 | VERY GOOD |
| | 10 | 14.5 | 29 | 34.8 | 108 | 201 | 0.19 | VERY GOOD |
| | 10 | 14.5 | 29 | 32.9 | 108 | 203 | 0.23 | VERY GOOD |
| | 10 | 14.5 | 29 | 31.3 | 108 | 202 | 0.27 | VERY GOOD |

FIG.11

| | INK VISCOSITY (mPa·sec) | TRANSFER RATE | JUDGMENT |
|---|---|---|---|
| COMPARATIVE EXAMPLE | 2250 | 86 | VERY POOR |
| | 3020 | 94 | POOR |
| | 4870 | 98 | FAIR |
| THE PRESENT INVENTION | 5120 | 99.71 | GOOD |
| | 8250 | 99.82 | GOOD |
| | 8250 | 99.95 | VERY GOOD |

IMAGE FORMING APPARATUS AND IMAGE FORMING METHOD WITH DECREASED IMAGE TRANSFER DISTURBANCE

BACKGROUND OF THE INVENTION

1. Field of the Invention

The present invention relates to an image forming apparatus and an image forming method, and more particularly, to image forming technology for forming an image on a recording medium by using a liquid such as ink.

2. Description of the Related Art

Inkjet recording apparatuses which form a desired image by ejecting ink onto a medium are subject to demands for higher image quality as well as demands for higher image recording speed. These demands are mutually contradictory, and various ways have been contrived in order to resolve these conflicting issues. For example, in cases where a recording medium having permeable characteristics, such as paper, is used, ink droplets permeate into the recording medium and image degradation occurs due to bleeding, dot spreading (shape abnormalities), or the like. Technology is used in which an image is formed provisionally on an intermediate transfer body having non-permeable characteristics, whereupon the image is transferred to a recording medium, thereby suppressing the ink permeation into the recording medium.

Japanese Patent Application Publication No. 10-250052 discloses an invention wherein a primary image is recorded onto an intermediate transfer body by using UV ink which is curable by irradiation of ultraviolet light, the viscosity of the UV ink forming the primary image is increased by radiating ultraviolet light onto the primary image, and the primary image is then transferred onto paper forming a recording medium, thereby making it possible to record a secondary image on the recording medium in a short time.

Japanese Patent Application Publication No. 2005-161603 discloses an inkjet recording method in which a radiation-curable ink is cured on an intermediate transfer body by means of radiation and then the cured ink is transferred by heating at a temperature that is higher than $T_g$ (i.e., the glass transition temperature) of the cured ink.

Japanese Patent Application Publication No. 2001-179960 discloses an inkjet recording apparatus comprising a light irradiation device which is provided inside an intermediate transfer body provided for temporarily holding ink ejected from a recording head (which is also simply referred to as a "head") and which radiates light curing the ink, wherein the amount (degree) of the light irradiation increases successively, from the ink ejection part onto which the ink is ejected from the head, to the transfer part where the ink is transferred to a recording medium, to the cleaning part where residual ink on the intermediate transfer body is removed.

Japanese Patent Application Publication No. 2005-153368 discloses a composition in which high-viscosity ink of 10000 mPa s or above is applied to a transfer roller by means of a roll coater or blade, an image is then created thereon-using low-viscosity ultraviolet-curable color inkjet ink, and this image is transferred to a printing roller, whereby transferring onto a curved printing medium can be achieved without deteriorating image quality.

However, for instance, when ink droplets ejected from a head onto a medium in order to form an image make contact with each other and combine before fixing on the medium, depositing interference occurs, and hence displacement of the dots formed by the ink and dot shape abnormalities occur, leading to marked deterioration of image quality. This phenomenon is particularly marked in cases of using a medium having non-permeable characteristics (including a medium having an extremely slow permeation speed).

FIG. 16 is a diagram showing a situation of the above-described depositing interference. As shown in FIG. 16, when an ink 32 ejected in the form of a droplet onto an intermediate transfer medium 16 from heads 12C, 12M, 12K, 12Y makes contact with another ink 32 deposited previously onto the intermediate transfer body 16, it is drawn toward the previously deposited ink 32, thus giving rise to beading (combination). If beading of this kind arises, then displacement occurs in the dot formation positions.

In the inventions described in Japanese Patent Application Publication No. 10-250052 and Japanese Patent Application Publication No. 2005-161603, depositing interference is liable to occur if ink droplets make contact with each other before irradiation of ultraviolet light. Moreover, in the invention described in Japanese Patent Application Publication No. 2001-179960, in cases where high-speed printing is performed, depositing interference is liable to occur if ink droplets make contact with each other before light is radiated onto the ink ejection part by the light irradiation device.

Japanese Patent Application Publication No. 2005-153368 does not disclose a method of avoiding depositing interference of the color ink ejected in the form of droplets by the inkjet head. If the viscosity of the previously applied high-viscosity ink is too high, then it is difficult for the low-viscosity color ink to penetrate into the film of high-viscosity ink, and hence depositing interference is liable to occur when the color ink is deposited. Furthermore, in order to put a high-viscosity ink having a viscosity of 10000 mPa·s or above onto a transfer roller, it is necessary to apply the ink to the whole surface of the transfer roller by means of a roll coater, blade, or the like, and therefore the consumption of high-viscosity ink rises.

SUMMARY OF THE INVENTION

The present invention has been contrived in view of the foregoing circumstances, an object thereof being to provide an image forming apparatus and an image forming method for preventing the occurrence of depositing interference when liquid is provided onto a medium so that a desirable image is formed without visible density non-uniformities.

In order to attain the aforementioned object, the present invention is directed to an image forming apparatus comprising: an intermediate transfer body; a liquid adhesion device which provides a first liquid having a viscosity not less than 15 mPa·s and not greater than 300 mPa·s at 25° C., on the intermediate transfer body; a droplet ejection device which ejects a second liquid containing a coloring material onto a region of the intermediate transfer body where the first liquid is provided by the liquid adhesion device, in a state where the first liquid on the intermediate transfer body has a thickness not less than 1.6 μm; a viscosity raising device which raises a viscosity of the second liquid on the intermediate transfer body; and a transfer device which transfers an image including dots of the second liquid formed on the intermediate transfer body, onto a recording medium.

In this aspect of the present invention, since the first liquid having a viscosity of 15 mPa·s to 300 mPa·s at 25° C. is given onto the intermediate transfer body, and the second liquid containing a coloring material is deposited in a state where the thickness of the first liquid layer is 1.6 μm or above, then depositing interference does not occur even if droplets of the second liquid make contact with each other on the intermediate transfer body, and therefore a desirable image can be obtained.

Moreover, the viscosity of the second liquid forming dots of the image is raised on the intermediate transfer body, and the dots (image) formed by the second liquid are transferred to the recording medium after being fixed provisionally on the intermediate transfer body. Hence, image disturbance on the intermediate transfer body and image disturbance during the transfer are prevented.

The first liquid is a transparent liquid which contains substantially no coloring material. As an example of liquid which contains substantially no coloring material, liquid containing a very small amount of coloring material of 1 wt % or less is cited.

The viscosity raising device may be a cooling device which cools the second liquid, or a curing energy application device which applies curing energy to the second liquid. The second liquid should have a viscosity of a level which prevents it from moving from the prescribed position on the intermediate transfer body (for example, a semi-cured state). It is also possible to adopt a composition in which, when transferring the second liquid to a recording medium after setting the second liquid to a cured state on the intermediate transfer body by means of the viscosity raising device, the viscosity of the second liquid is lowered to a viscosity suitable for the transfer.

Furthermore, the viscosity raising device may also raise the viscosity of the first liquid on the intermediate transfer body. Of course, it is possible to maintain the viscosity of the first liquid at a constant value (e.g., the viscosity which the first liquid has when the first liquid is given onto the intermediate transfer body). In a mode where the viscosity of the first liquid is kept at a constant value from the deposition on the intermediate transfer body, desirably, a removal device which removes the first liquid is provided, and more desirably, the first liquid is removed before the second liquid (image) is transferred to the recording medium.

As a mode for providing the first liquid onto the intermediate transfer body, there is a mode where a droplet ejection device which ejects droplets of the first liquid is used. Moreover, the first liquid may be applied on the intermediate transfer body by means of an application device.

There is a mode where the droplet ejection device comprises a nozzle which ejects liquid droplets, a liquid chamber which accommodates the liquid to be ejected in the form of droplets from the nozzle, and an ejection force generating element which applies an ejection force to the liquid accommodated in the liquid chamber. The droplet ejection device which ejects droplets of the first liquid may have the same composition as the droplet ejection device which ejects droplets of the second liquid, or it may have a different composition from the droplet ejection device which ejects droplets of the second liquid.

The recording medium may include various types of media. For example, there is continuous paper, cut paper or other paper, a resin sheet, a metal sheet, fibers (cloth), or the like.

Preferably, relationship between a dynamic surface tension $\gamma_1$ at a surface age of 0.1 sec of the first liquid and a dynamic surface tension $\gamma_2$ at a surface age of 0.1 sec of the second liquid satisfies a following relationship: $\gamma_1<Y_2$.

In embodiments of the present invention, the dynamic surface tension is determined according to the Maximum Bubble Pressure Method. In the Maximum Bubble Pressure Method, a bubble is formed in the object liquid by sending gas at a predetermined flow rate from a capillary with a known radius r that sinks in the liquid. The pressure of the gas is measured during the bubble formation, and the maximum pressure is determined. The surface tension ($\sigma$) at a surface age is determined according to this maximum pressure ($\rho_{max}$), the initial pressure ($\rho_0$) in the capillary, and the inner radius (r) of the capillary. More specifically, the surface tension at a surface age is determined according to the following formula: $\sigma=(\rho_{max}-\rho_0)\times r/2$. The surface age corresponds to time that elapses before the pressure becomes the maximum. Surface tensions for various surface ages are measured by changing the flow rate of the gas, and the dynamic surface tension can be determined according to the surface tensions thus measured.

In this aspect of the present invention, by suitably adjusting the relationship between the dynamic surface tension $\gamma$1 of the first liquid and the dynamic surface tension $\gamma$2 of the second liquid, depositing interference is prevented when the second liquid deposits onto the intermediate transfer body.

Preferably, the droplet ejection device comprises a full line liquid ejection head having a nozzle row in which nozzles ejecting the second liquid are arranged through a length corresponding to a breadth of the intermediate transfer body.

In this aspect of the present invention, by using a full line type of liquid ejection head for the droplet ejection device, higher-speed printing (image formation) become possible, in comparison with a shuttle scanning type of liquid ejection head in which a short head having a length that is shorter than the width of the intermediate transfer body performs liquid ejection in the breadthways direction while moving in the breadthways direction. Furthermore, even when printing is performed at high speed, it is still possible to obtain a desirable image which is free of depositing interference and dot spreading.

Preferably, the second liquid contains a radiation-curable polymerizable compound; and the viscosity raising device comprises a radiation irradiation device.

The radiation may include ultraviolet light, an electron beam, and the like, and it has energy for causing a polymerization reaction of the polymerizable compound. There is a mode in which a radiation irradiation control device is provided for controlling the on/off switching of the radiation-curable device, the irradiation amount (irradiation energy), the irradiation time, and the like.

Preferably, the second liquid contains a radiation-curable polymerizable compound; the intermediate transfer body has a hollow round cylindrical shape; the viscosity raising device comprises a radiation irradiation device which is arranged inside the intermediate transfer body and which irradiates the second liquid on the intermediate transfer body with a radiation; and at least a portion of the intermediate transfer body which is irradiated with the radiation by the radiation irradiation device is composed of a member which transmits the radiation.

In this aspect of the present invention, by emitting radiation from the interior of the intermediate transfer body, it is possible to preferentially cure a surface of the second liquid (and the first liquid) that makes contact with the intermediate transfer body. Moreover, by providing the radiation irradiation device inside the intermediate transfer body, it is possible to manufacture the apparatus more compact in size.

Preferably, the second liquid contains an ultraviolet-curable polymerizable compound; at least one of the first liquid and the second liquid contains a polymerization initiator; and the viscosity raising device comprises an ultraviolet light irradiation device.

In this aspect of the present invention, it is possible to raise the viscosity of the second liquid efficiently by using a relatively inexpensive ultraviolet light irradiation device.

A polymerization initiator may be contained in the first liquid, and it may be contained in the second liquid. A desirable mode is one in which a polymerization initiator is contained in the first liquid, which does not contain an ultraviolet-curable polymerizable compound.

Preferably, the viscosity raising device raises the viscosity of the second liquid on the intermediate transfer body to not less than 5000 mPa·s.

In particular, in a mode where the viscosity of the second liquid is set to 5000 mPa·s or above by using the ultraviolet light irradiation device as described above, it is possible to speed up the raising of the viscosity of the second liquid.

Preferably, the image forming apparatus further comprises a main curing device which performs main curing of the image on the recording medium.

In this aspect of the present invention, it is possible to fix an image onto the recording medium in a reliable fashion.

In a mode where a radiation-curable (ultraviolet-curable) polymerizable compound is contained in the second liquid as described above, it is possible to use a radiation (ultraviolet light) irradiation device as the main curing device.

Preferably, the transfer device comprises a heating device which heats the dots of the second liquid to a temperature not less than a glass transition temperature of the second liquid.

In this aspect of the present invention, the separability of the second liquid is good, and hence it is possible to prevent image disturbance during the transferring of an image from the intermediate transfer body to a recording medium, by means of a simple composition.

In order to attain the aforementioned object, the present invention is also directed to an image forming method for forming an image on an intermediate transfer body and transferring the image from the intermediate transfer body onto a recording medium, the image forming method including the steps of: providing a first liquid having a viscosity not less than 15 mPa·s and not greater than 300 mPa·s at 25° C., on the intermediate transfer body; ejecting a second liquid containing a coloring material onto a region of the intermediate transfer body where the first liquid is provided, in a state where the first liquid has a thickness not less than 1.6 μm on the intermediate transfer body; raising a viscosity of the second liquid on the intermediate transfer body; and transferring the image including dots of the second liquid formed on the intermediate transfer body, onto the recording medium.

Preferably, the viscosity of the second liquid on the intermediate transfer body is raised by curing the second liquid; and the image is transferred onto the recording medium while the second liquid that has been cured is heated to a temperature not less than a glass transition temperature of the second liquid.

In this aspect of the present invention, image deterioration on the intermediate transfer body is prevented by curing the second liquid, and highly efficient image transferring is achieved by softening the second liquid to a viscosity suitable for the transfer, during the transfer process.

Preferably, the viscosity of the second liquid on the intermediate transfer body is raised to not less than 5000 mPa·s.

In this aspect of the present invention, the viscosity of the second liquid is adjusted to a viscosity suitable for the transfer. Moreover, increased speed can be expected both in raising the viscosity of the second liquid and in the image formation process as a whole.

According to the present invention, since the first liquid having a viscosity of 15 mPa·s to 300 mPa·s at 25° C. is given onto the intermediate transfer body, and the second liquid containing a coloring material is deposited in a state where the thickness of the first liquid is 1.6 μm or above, then depositing interference does not occur even if droplets of the second liquid make contact with each other on the intermediate transfer body, and therefore a desirable image can be obtained.

Furthermore, since the dots (image) formed by the second liquid are transferred to the recording medium after being fixed provisionally on the intermediate transfer body by raising the viscosity of the second liquid on the intermediate transfer body, image disturbance on the intermediate transfer body and image disturbance during transfer are prevented.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 8 is a diagram showing the degree of depositing interference depending on the thickness of the treatment liquid;

FIG. 9 is a diagram showing the degree of depositing interference depending on the viscosity of the treatment liquid;

FIG. 10 is a diagram showing the degree of depositing interference depending on the relationship between the dynamic surface tensions of the treatment liquid and the ink;

FIG. 11 is a diagram showing the relationship between the ink viscosity and the transfer rate;

DETAILED DESCRIPTION OF THE PREFERRED EMBODIMENTS

First Embodiment

Figure 1:
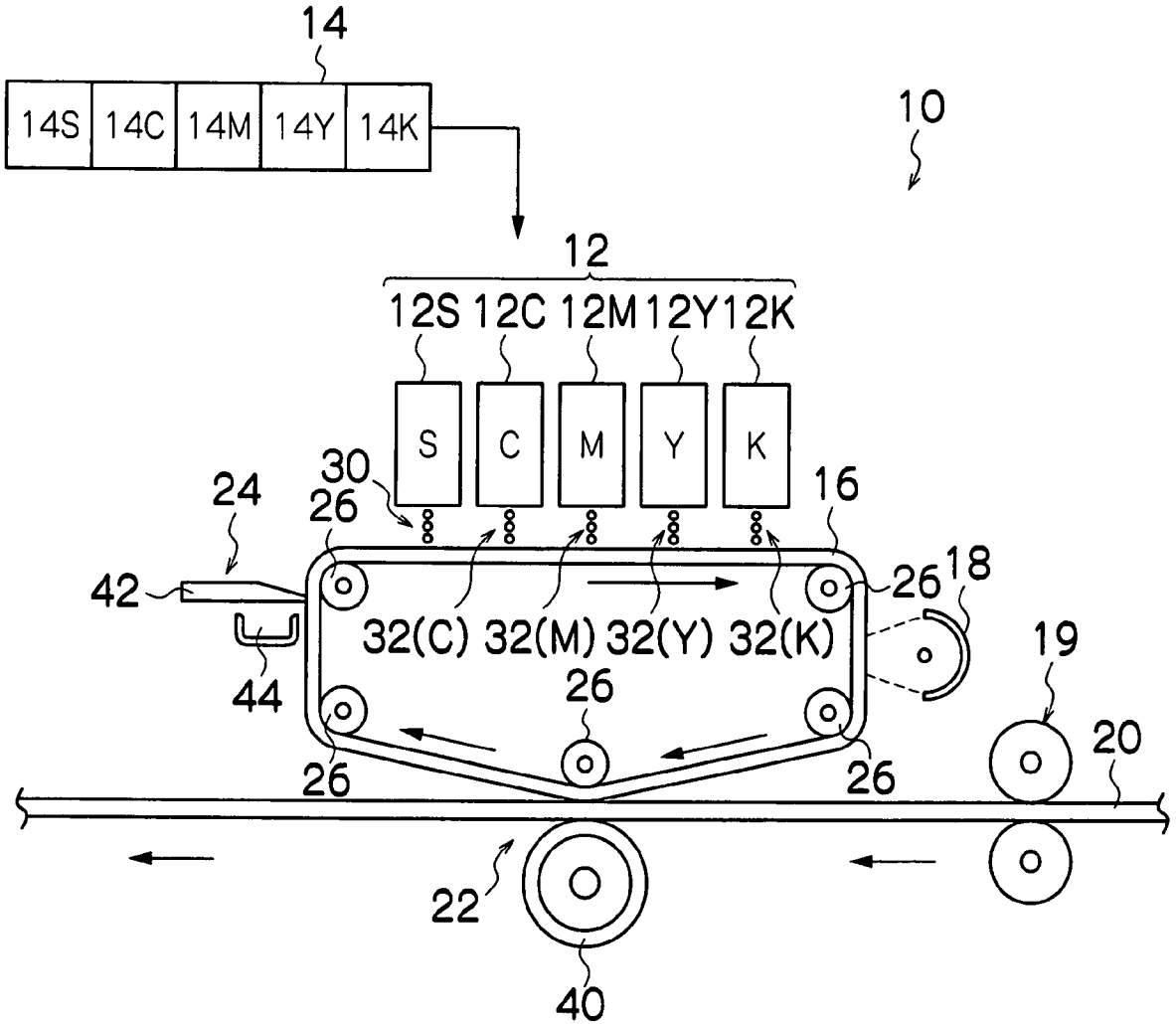
FIG. 1 is a general schematic drawing of an inkjet recording apparatus according to an embodiment of the present invention.

FIG. 1 is a diagram showing a general composition of an inkjet recording apparatus according to an embodiment of the present invention. As shown in FIG. 1, this inkjet 20 recording apparatus 10 comprises a print unit 12 which includes a treatment liquid head 12S corresponding to a treatment liquid (S, first liquid) 30, and a plurality of inkjet heads (hereinafter, called heads) 12C, 12M, 12Y, 12K provided so as to correspond to the respective inks (second liquids) 32 of the colors cyan (C), magenta (M), yellow (Y) and blank (K).

The treatment liquid (first liquid) 30 used in the present embodiment is a transparent liquid (containing substantially no coloring material) which contains an ultraviolet-curable polymerizable compound (monomer, oligomer or compound of these), and it has a viscosity of 15 to 300 mpa·s at 25° C. Even if the treatment liquid 30 contains 1 wt % or less of ink coloring material, it is substantially transparent.

Each of the inks 32 corresponding to the respective colors contains the corresponding coloring material (pigment) and a polymerization initiator. Furthermore, the treatment liquid 30 and the inks 32 also contain other additives such as surfactant. These additives are adjusted in such a manner that the dynamic surface tension $\gamma 1$ at a surface age of 0.1 s of the treatment liquid 30 is less than the dynamic surface tension $\gamma 2$ at a surface age of 0.1 s of the ink 32 (in other words, the relationship "$\gamma 1 < \gamma 2$" is satisfied). The details of the treatment liquid 30 and the inks 32 are described below.

Furthermore, the inkjet recording apparatus 10 comprises: a storing and loading unit 14 which stores inks 32 to be supplied to the heads 12C, 12M, 12Y, 12K and treatment liquid 30 to be supplied to the treatment liquid head 12S; an intermediate transfer body 16 onto which an image is formed by droplets of the treatment liquid 30 and the inks 32 ejected from the heads 12S, 12C, 12M, 12Y, 12K; an ultraviolet light source 18 (viscosity raising device) which radiates ultraviolet light onto the inks 32 (or the treatment liquid 30) on the intermediate transfer body 16 so as to raise the viscosity of the inks 32 (or the treatment liquid 30); a transfer unit 22 which heats an image on the intermediate transfer body 16 by means of a heating roller 40 and transfers an image on the intermediate transfer body 16 to a recording medium 20 which is conveyed while being supported on a supporting roller 19 so that the recording medium 20 is kept flat; and a cleaning unit 24 which removes residual ink (and treatment liquid) from the intermediate transfer body 16 after the transfer.

As shown in FIG. 1, an endless belt member which is wound around five rollers 26 is used as the intermediate transfer body 16, and as the rollers 26 rotate in the clockwise direction, the intermediate transfer body 16 moves from left to right in FIG. 1 in the region opposing the print unit 12. If such a belt-shaped member is used for the intermediate transfer body 16, then it is possible to dispose the heads 12S, 12C, 12M, 12Y, 12K in a horizontal fashion.

In the region where the intermediate transfer body 16 opposes the print unit 12, droplets of the treatment liquid 30 ejected from the head 12S are deposited on a prescribed image forming region of the intermediate transfer body 16 so that the thickness t of the treatment liquid 30 on the intermediate transfer body 16 becomes 1.6 μm or above, and droplets of the inks 32 are then ejected from the heads 12C, 12M, 12Y, 12K.

A non-permeable medium which allows no penetration of the treatment liquid 30 and the ink droplets 32 is used for the intermediate transfer body 16. This non-permeable medium may also include a medium having an extremely slow permeation speed with respect to the treatment liquid 30 and the ink droplets 32. Concrete embodiments of the medium used for the intermediate transfer body 16 include resin, metal, and the like.

Figure 2:
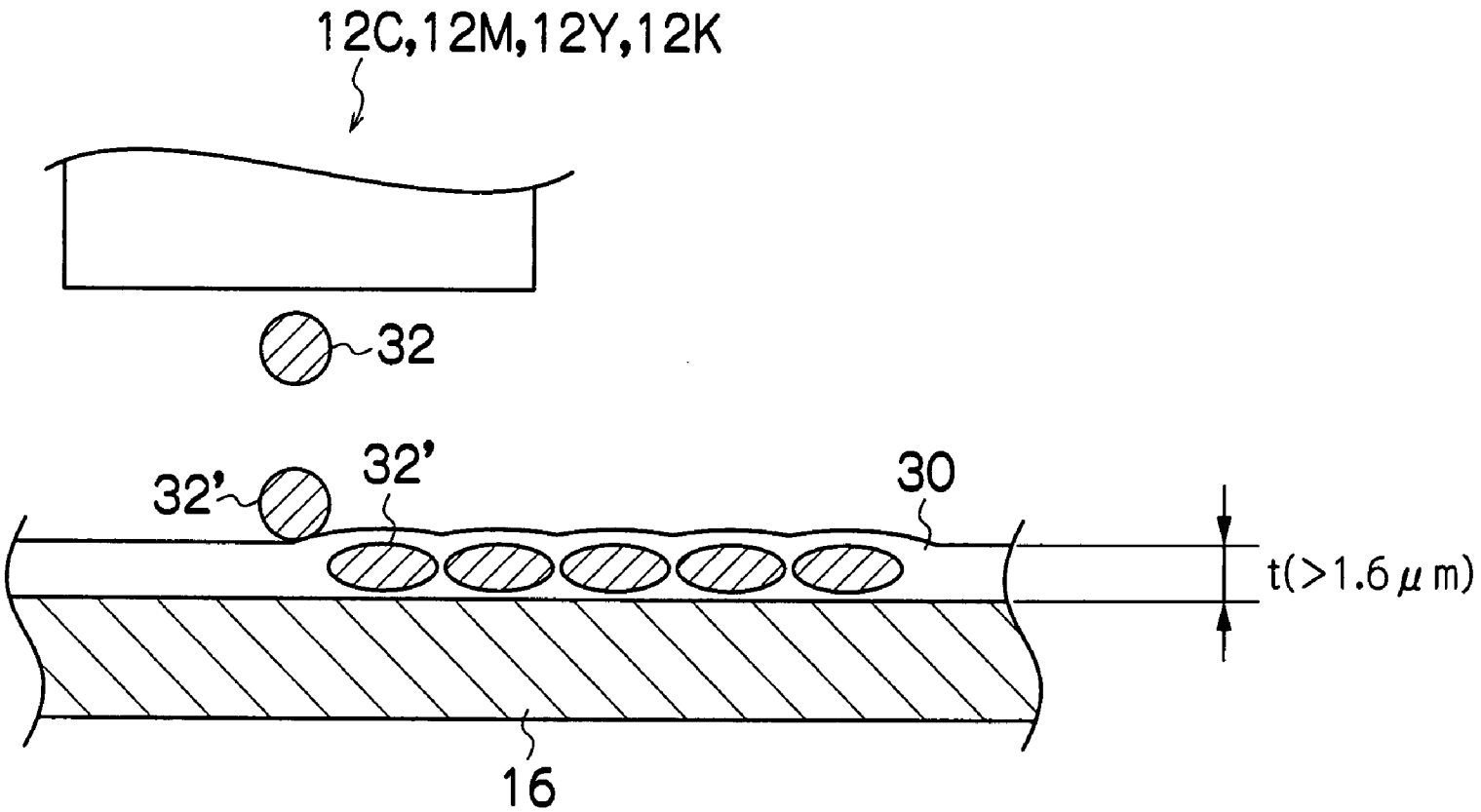
FIG. 2 is a diagram showing a state of treatment liquid and ink droplets deposited on an intermediate transfer body.

FIG. 2 is a diagram showing a state where droplets of inks 32 ejected from the heads 12C, 12M, 12Y, 12K are deposited onto the intermediate transfer body 16 on which the treatment liquid 30 are deposited previously. As shown in FIG. 2, since the treatment liquid 30 is present on the intermediate transfer body 16, the ink droplets 32' being deposited on the intermediate transfer body 16 (namely, on a treatment liquid film 30 having a prescribed thickness) are located independently, and dots are formed in the prescribed positions, without occurrence of depositing interference of the ink droplets 32'.

The treatment liquid 30 deposited on the intermediate transfer body 16 and the ink droplets 32' deposited on the intermediate transfer body 16 are cured by ultraviolet light (energy) radiated from the ultraviolet light source 18 shown in FIG. 1, and are thereby solidified (fixed) provisionally on the intermediate transfer body 16.

It is not necessary to cure the treatment liquid 30 and the ink droplets 32' completely by means of this irradiation of ultraviolet light, and it is sufficient that the ink droplets 32' are cured to an extent whereby they do not move on the intermediate transfer body 16. For example, the viscosity of the ink droplets 32' should be raised to 5000 mPa·s or above by the irradiation of ultraviolet light.

If the ultraviolet light radiated from the ultraviolet light source 18 is radiated onto the nozzles 51 of the heads 12C, 12M, 12Y, 12K which eject ink droplets 32 (droplets of liquid which contains an ultraviolet-curable polymerizable compound), then the ink inside the nozzles 51 may become cured. Therefore, it is necessary to position the ultraviolet light source 18 in such a manner that the ultraviolet light beam does not reach the nozzles 51 of the heads 12C, 12M, 12Y, 12K.

In a mode where the heads 12C, 12M, 12Y, 12K are disposed in the vicinity of the ultraviolet light source 18, then desirably, a light shielding member which blocks off the ultraviolet light radiated from the ultraviolet light source 18 is provided for the heads 12C, 12M, 12Y and 12K.

The treatment liquid 30 and the ink droplets 32' fixed provisionally on the intermediate transfer body 16 in this way are heated to a temperature at or above the glass transition temperature by the heating roller 40 of the transfer unit 22, and are pressed against the recording medium 20 at a prescribed pressure and are thereby transferred from the intermediate transfer body 16 to the recording medium 20.

In a mode where the ink droplets 32' are not cured completely on the intermediate transfer body 16, the amount of ultraviolet light irradiated (the irradiation time) should be controlled in such a manner that the viscosity of the ink droplets 32' is raised by the irradiation of ultraviolet light to a viscosity that is suitable for the transfer by the transfer unit 22. In a mode in which the ink droplets 32' are not completely cured in this way, it is not necessary to carry out the heating in the transfer unit 22, and the curing time of the ink droplets 32' by irradiation of ultraviolet light, and the softening time of the ink droplets 32' during the transfer can be shortened (or reduced to zero). Therefore, increased efficiency of the overall image recording process can be expected. For example, during the transfer, the viscosity of the ink droplets 32' (corresponding to the second liquid) should be 5000 mPa·s or above.

Concrete examples of the recording medium 20 include continuous paper, cut paper, other types of paper, resin film such as OHP sheets, metal sheets, cloth, wood, and various other types of media.

When an image formed on the intermediate transfer body 16 is transferred to the recording medium 20 in this way, then the image forming region of the intermediate transfer body 16 is moved to the cleaning unit 24, and the treatment liquid 30 and the ink droplets 32 remaining on the image forming region are removed. The cleaning unit 24 shown in FIG. 1 comprises: a blade 42 which removes the residual treatment liquid and the residual ink while making contact with the intermediate transfer body 16; and a recovery unit 44 which recovers the residual treatment liquid and the residual ink thus removed.

In order to remove the residual treatment liquid and the residual ink from the intermediate transfer body 16, the following methods may be adopted, for example. More specifically, for example, a method where the intermediate transfer body 16 is nipped with a brush roller, a water absorbent roller, or the like; an air blowing method where clean air is blown onto the intermediate transfer body 16; or a combination of these can be adopted in dependence upon the situation. In the case of a configuration in which the intermediate transfer body 16 is nipped with a cleaning roller, it is preferable to make the linear velocity of the cleaning roller different from that of the intermediate transfer body 16, in order to improve the cleaning effect.

The storing and loading unit 14 comprises a treatment liquid tank 14S which stores the treatment liquid for the head 12S, and tanks 14C, 14M, 14Y, 14K which store the inks of colors for the respective heads 12C, 12M, 12Y, 12K. The tanks are connected to the respective heads 12S, 12C, 12M, 12Y, 12K, via prescribed flow channels. Furthermore, the storing and loading unit 14 includes: a warning device (for example, a display device or an alarm sound generator) for warning when the remaining amount of treatment liquid or ink is low; and a mechanism for preventing loading errors among the colors.

Although not shown in FIG. 1, there is a mode in which a magazine for roll paper (continuous paper) is provided in the paper supply unit which supplies the recording medium 20. It is also possible to use jointly a plurality of magazines containing papers of different widths and qualities, and the like. Moreover, papers may be supplied in cassettes that contain cut papers loaded in layers and that are used jointly or in lieu of magazines for rolled papers.

In the case of a configuration in which a plurality of types of recording paper can be used, it is preferable that an information recording medium, such as a bar code or a wireless tag, containing information about the type of paper be attached to the magazine. By reading the information contained in the information recording medium with a predetermined reading device, the type of recording medium to be used is automatically determined, and the ink-droplet ejection is controlled so that the ink-droplets are ejected in an appropriate manner in accordance with the type of medium.

Furthermore, the recording medium 20 delivered from the paper supply unit described above retains curl due to having been loaded in the magazine. In order to remove the curl, a decurling unit is provided and heat is applied to the recording medium in the decurling unit by a heating drum, in the direction opposite to the direction of curl in the magazine. In this, the heating temperature is preferably controlled in such a manner that the medium has a curl in which the surface on which the print is to be made is slightly rounded in the outward direction.

In the case of a configuration in which roll paper is used, a cutter (a first cutter) is provided and the continuous paper is cut to a desired size by the cutter. In one mode of the cutter, the cutter includes a stationary blade whose length is not less than the width of the conveyor pathway of the recording medium 20, and a round blade which moves along the stationary blade. The stationary blade is disposed on the reverse side of the printed surface of the recording paper, and the round blade is disposed on the side adjacent to the printed surface across the conveyance path. When cut paper is used, the cutter is not required.

Figure 3:
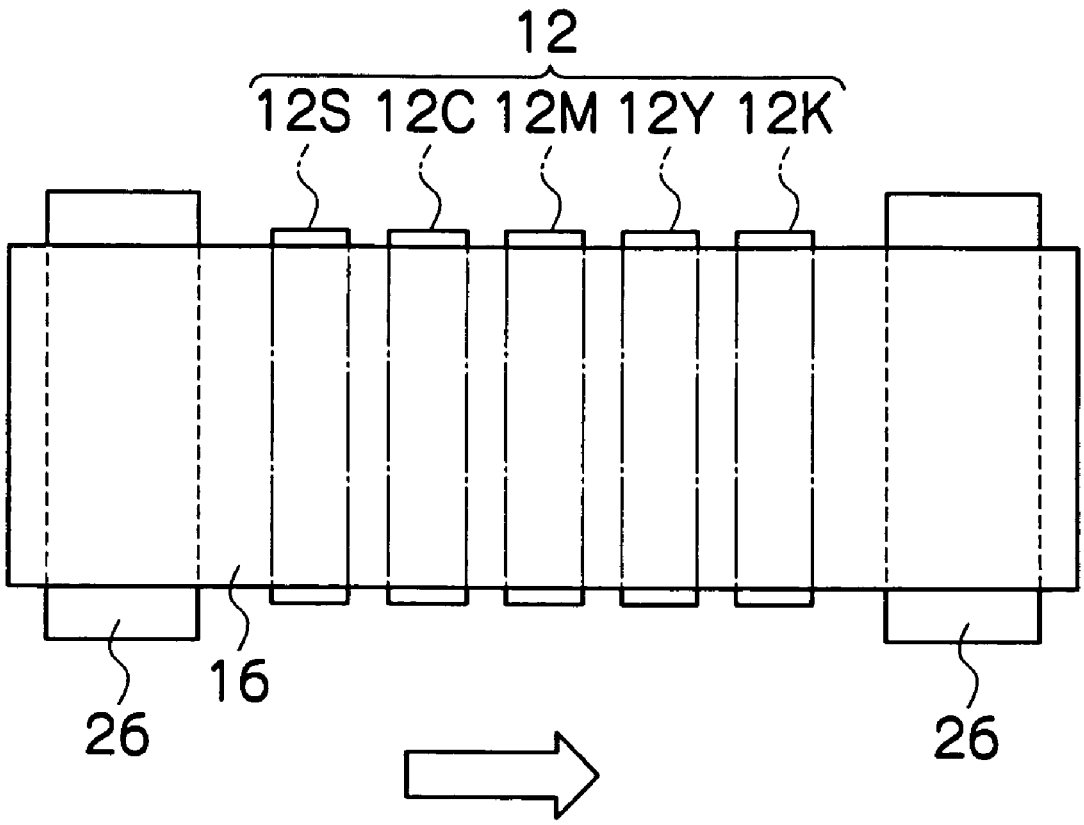
FIG. 3 is a principal plan diagram of the peripheral area of a print unit in the inkjet recording apparatus shown in FIG. 1.

The heads 12S, 12C, 12M, 12Y, 12K of the print unit 12 have a length corresponding to the maximum width of the intermediate transfer body 16 (the image forming region), and each head is a full-line head in which a plurality of nozzles for ejecting the treatment liquid or corresponding ink are arranged in the nozzle surface of the head through the full width of the image forming region (see FIG. 3).

The heads 12S, 12C, 12M, 12Y, 12K are arranged in color order of the treatment liquid (S), cyan (C), magenta (M), yellow (Y) and black (K) from the upstream side in the delivery direction of the intermediate transfer body 16, and these heads 12S, 12C, 12M, 12Y, 12K are fixed so as to be disposed in the conveyance direction of the intermediate transfer body 16.

A color print can be formed on the intermediate transfer body 16 by ejecting the treatment liquid and the inks of different colors from the heads 12S, 12C, 12M, 12Y, 12K, respectively, onto the intermediate transfer body 16 while the intermediate transfer body 16 is moved.

By adopting a configuration in which full line heads 12C, 12M, 12Y, 12K having nozzle rows covering the full width of the intermediate transfer body 16 are provided for the respective colors in this way, it is possible to record an image on the full surface of the intermediate transfer body 16 by performing just one operation (in other words, by means of one sub-scanning action) of relatively moving the intermediate transfer body 16 and the print unit 12 in the conveyance direction (the sub-scanning direction). Higher-speed printing is thereby made possible and productivity can be improved, in comparison with a shuttle type head configuration in which a head moves reciprocally in a direction which is perpendicular to the conveyance direction (sub-scanning direction).

Although a configuration with the four standard colors of C, M, Y, and K is described in the present embodiment, the combinations of the ink colors and the number of colors are not limited to those. Light and/or dark inks, and special color inks may be added as required. For example, a composition is possible in which inkjet heads for ejecting light inks, such as light cyan and light magenta, are added, and a mode is also possible in which a plurality of treatment liquid heads 12S are provided to correspond to a plurality of treatment liquids (for example, liquids having different viscosities or other properties). Furthermore, there are no particular restrictions of the sequence in which the heads of respective colors are arranged.

The printed matter (the recording medium 20 formed with a desired image) generated in this manner is outputted from a paper output unit (not shown in drawings). The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to the paper output units respectively. When the target print and the test print are simultaneously formed in parallel on the same large sheet of paper, the test print portion is cut and separated by a cutter (second cutter). The cutter is disposed directly in front of the paper output units, and is used for cutting the test print portion from the target print portion when a test print has been performed in the blank portion of the target print. The structure of the cutter is the same as the first cutter described above, and has a stationary blade and a round blade. The paper output unit for the target prints is provided with a sorter for collecting prints according to print orders.

Structure of the Head

Next, the structure of a head is described. The heads 12S, 12C, 12M, 12Y, 12K of the treatment liquid and the respective ink colors have the same structure, and a reference numeral 50 is hereinafter designated to any of the heads.

Figure 4A:
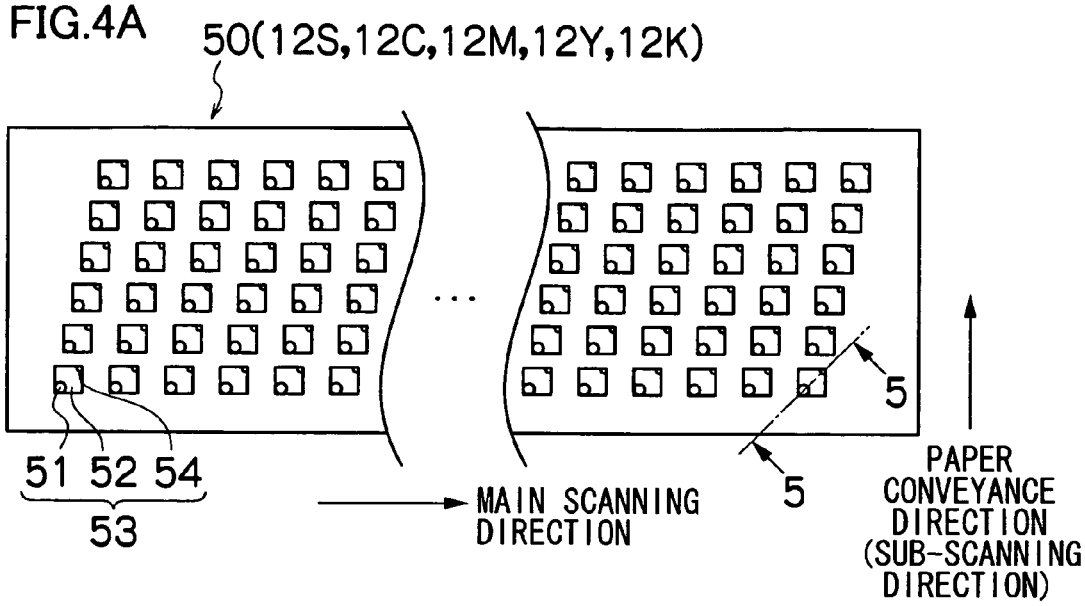
FIGS. 4A to 4C are plan view perspective diagrams showing embodiments of the composition of a print head.
Figure 4B:
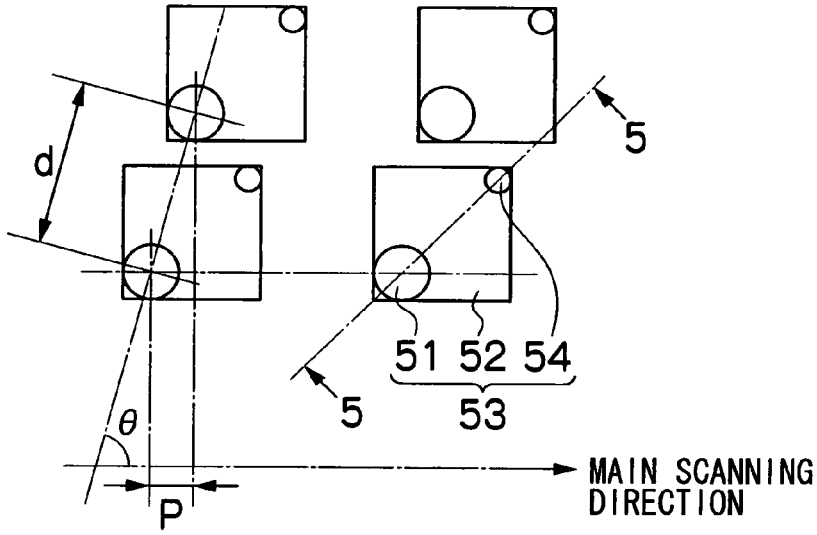
Figure 4C:
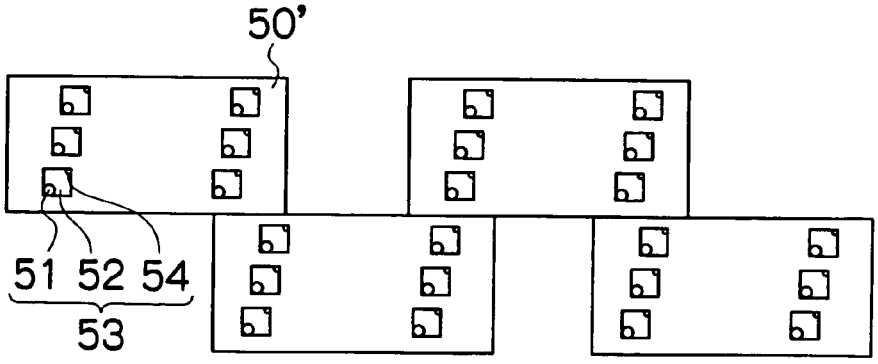
Figure 5:
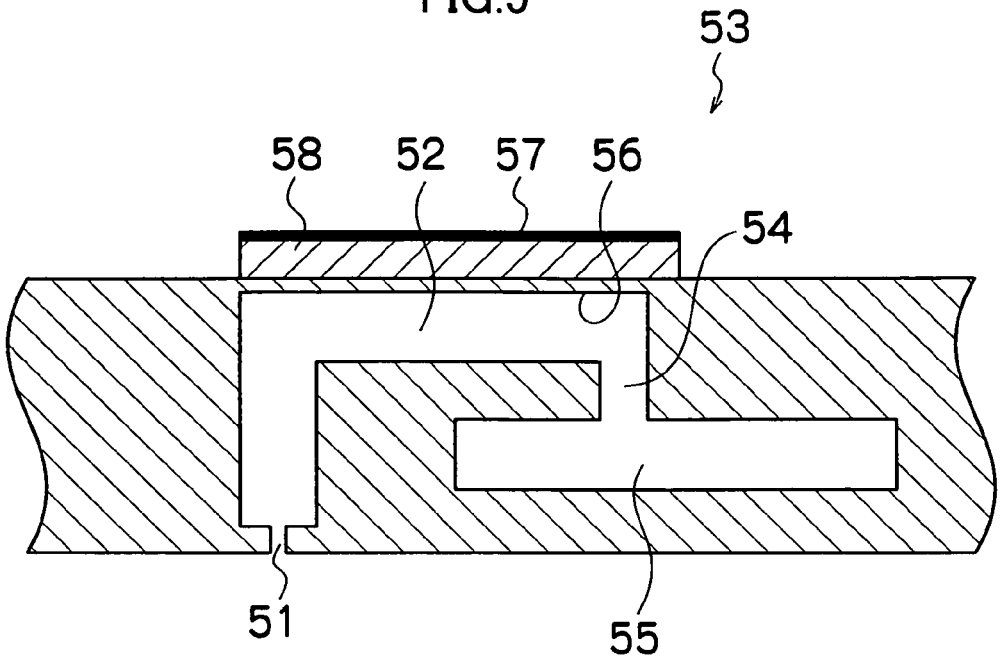
FIG. 5 is a diagram showing a cross-sectional view along line 5-5 in FIGS. 4A and 4B.

FIG. 4A is a plan view perspective diagram showing an embodiment of the structure of a head 50, and FIG. 4B is an enlarged diagram showing a portion of same. Furthermore, FIG. 4C is a plan view perspective diagram showing a further embodiment of the composition of the print head 50, and FIG. 5 is a cross-sectional diagram (along line 5-5 in FIG. 4A and FIG. 4B) showing a composition of an ink chamber unit. In order to achieve a high density of the dot pitch formed onto the surface of the intermediate transfer body 16 (recording medium 20), it is necessary to achieve a high density of the nozzle pitch in the head 50. As shown in FIGS. 4A and 4B, the head 50 according to the present embodiment has a structure in which a plurality of ink chamber units 53, each comprising a nozzle 51 forming an ink droplet ejection aperture, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the intermediate transfer body 16 in a direction substantially orthogonal to the movement direction of the intermediate transfer body 16 is not limited to the embodiment described above. For instance, instead of the composition in FIG. 4A, as shown in FIG. 4C, a line head having nozzle rows of a length corresponding to the entire width of the intermediate transfer body 16 (the entire width of the image forming region) can be formed by arranging and combining, in a staggered matrix, short head blocks 50' having a plurality of nozzles 51 arrayed in a two-dimensional fashion.

The pressure chambers 52 provided corresponding to the nozzles 51 are each approximately square-shaped in plan view, and a nozzle 51 and a supply port 54 are provided respectively at either corner of a diagonal of each pressure chamber 52. Each pressure chamber 52 is connected via the supply port 54 to a common flow channel 55. The common flow channel 55 is connected to a tank (not shown in FIG. 5, but denoted with reference numeral 60 in FIG. 6) which is a source that supplies the treatment liquid and inks, and the treatment liquid and inks supplied from the tank are supplied through the common flow channel 55 shown in FIG. 5 to the pressure chambers 52.

Actuators 58 each of which is provided with an individual electrode 57 are bonded onto a diaphragm 56 which forms the upper face of the pressure chamber 52 and serves as a common electrode, and each actuator 58 is deformed when a drive voltage is supplied to the corresponding individual electrode 57, thereby causing ink to be ejected from the corresponding nozzle 51. When ink is ejected, new ink is supplied to the pressure chamber 52 from the common flow passage 55, via the supply port 54.

As shown in FIG. 4B, the head having high-density nozzles according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In embodiments of the present invention, the arrangement structure of the nozzles is not limited to the embodiment shown in the drawings, and it is also possible to apply various other types of nozzle arrangements, such as an arrangement structure having one nozzle row in the sub-scanning direction.

In the present embodiment, a mode is described in which the head 12S corresponding to the treatment liquid and the heads 12C, 12M, 12Y, 12K corresponding to the respective ink colors have the same composition, but the treatment liquid head 12S may be composed with a lower nozzle density than the heads 12C, 12M, 12Y, 12K.

In other words, it is not absolutely necessary for the dots formed by the treatment liquid 30 to correspond to the dots formed by the inks 32 in a one-to-one relationship, and it is sufficient that the treatment liquid 30 is present in the region of the depositing position of each ink droplet 32 and the area surrounding it. Furthermore, it is also possible to deposit a plurality of ink dots onto one dot of treatment liquid 30. In a mode where the nozzle density of the treatment liquid head 12S is formed to a lower density than that of the heads 12C, 12M, 12Y, 12K, time reductions can be expected in the step of depositing the treatment liquid 30 onto the intermediate transfer body 16, and furthermore, the manufacturability of the treatment liquid head 12S is improved.

Composition of Ink Supply System

Figure 6:
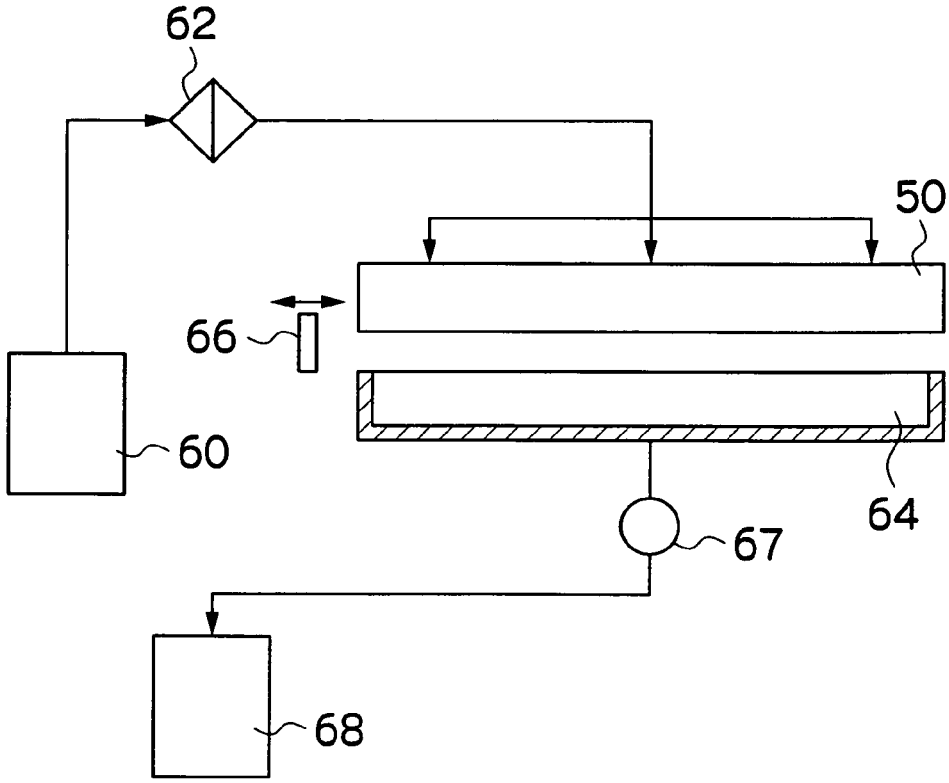
FIG. 6 is a schematic diagram showing the composition of a supply system in the inkjet recording apparatus shown in FIG. 1.

FIG. 6 is a conceptual diagram showing the composition of a supply system for supplying the treatment liquid and the inks in the inkjet recording apparatus 10. Since the treatment liquid supply system and the ink supply system have the same composition, then FIG. 6 shows the ink supply system and the following description relates to the ink supply system.

The tank 60 in FIG. 6 is a base tank that supplies ink to the head 50 and is set in the storing and loading unit 14 described above with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the tank 60 and the head 50 as shown in FIG. 6. The filter mesh size is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 also includes: a cap 64 as a device to prevent the nozzles 51 from drying out or to prevent an increase in the ink viscosity in the vicinity of the nozzles 51; and a cleaning blade 66 as a device to clean the nozzle face. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matters have adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink (the ink in which bubbles have become intermixed) inside the pressure chamber 52 is then removed by suction with a suction pump 67, and the suction-removed ink is sent to a collection tank 68. This suction action entails the suctioning of degraded ink (hardened ink) having an increased viscosity and degraded ink intermixed with bubbles when initially loaded into the head 50, or when printing is started after a long period of being stopped.

When a state in which ink is not ejected from the head 50 continues for a certain amount of time or longer, the ink solvent in the vicinity of the nozzles evaporates and ink viscosity increases. In such a state, ink can no longer be ejected from the nozzle 51 even if the actuator 58 for the ejection driving is operated. Before reaching such a state (within a viscosity range that allows ejection by the operation of the actuator 58), the actuator 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 due to the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, or when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face of the head 50, and the ink in which bubbles have become intermixed or the ink whose viscosity has increased is removed by the suction.

However, since this suction action is performed with respect to all the ink in the pressure chambers 52, then the amount of ink consumption is considerable. Therefore, an aspect is preferable in which a preliminary discharge is performed when the increase in the viscosity of the ink is small.

Description of Control System

Figure 7:
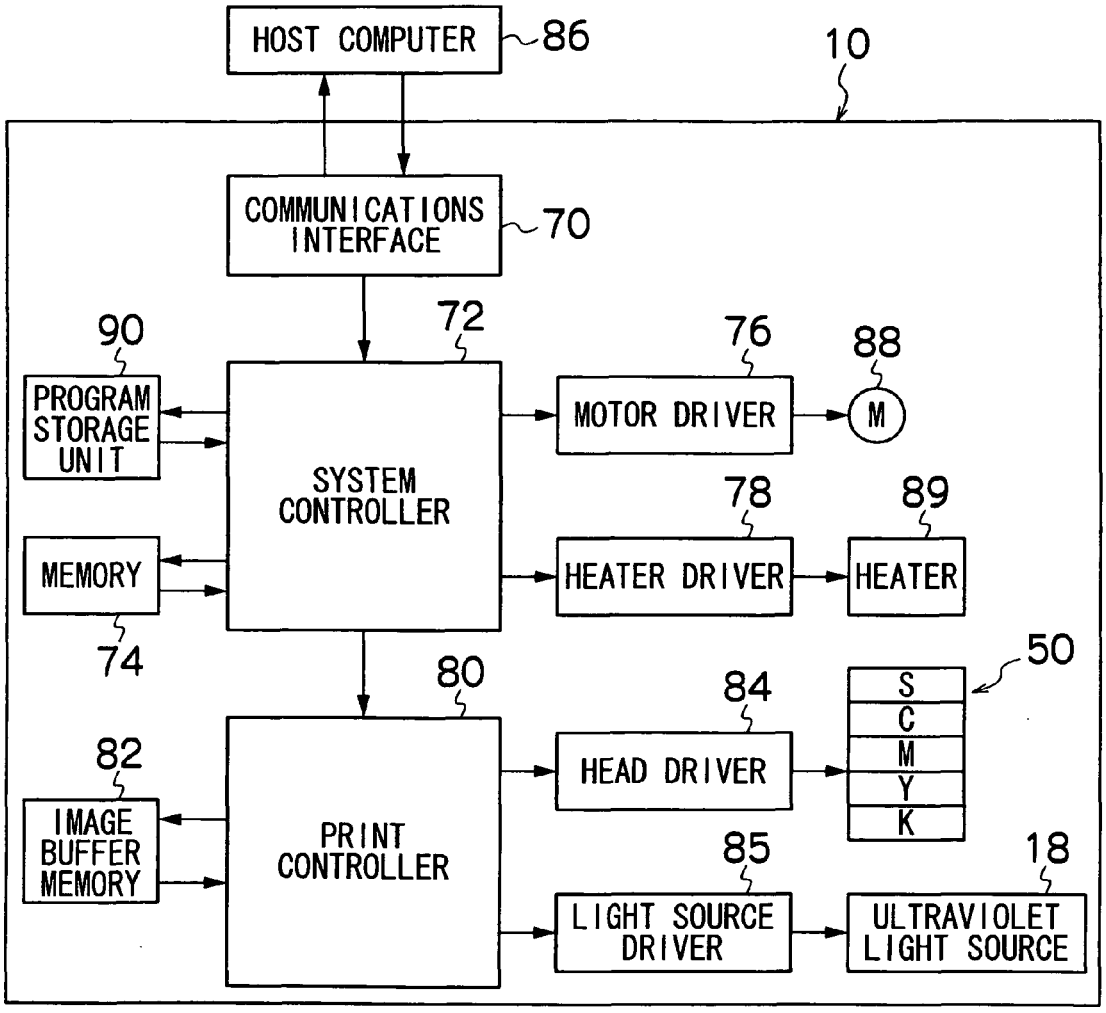
FIG. 7 is a principal block diagram showing the system configuration of the inkjet recording apparatus shown in FIG. 1.

FIG. 7 is a principal block diagram showing the system configuration of the inkjet recording apparatus 10. The inkjet recording apparatus 10 comprises a communications interface 70, a system controller 72, an image memory 74, a motor driver 76, a heater driver 78, a print controller 80, an image buffer memory 82, a head driver 84, a light source driver 58, and the like.

The communications interface 70 is an interface unit for receiving image data sent from a host computer 86. A serial interface such as USB (universal serial bus), IEEE1394, Ethernet(registered trademark), wireless network, or a parallel interface such as a Centronics interface may be used for the communications interface 70. A buffer memory (not shown) may be mounted in this portion in order to increase the communication speed. The image data sent from the host computer 86 is received by the inkjet recording apparatus 10 through the communications interface 70, and is temporarily stored in the image memory 74.

The image memory 74 is a storage device for temporarily storing images inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communications interface 70, image memory 74, motor driver 76, heater driver 78, and the like, and controls communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver 78 drives the heater 89 in accordance with commands from the system controller 72. The heater 89 may be a heater installed in the heating roller 40 of the transfer unit 22 shown in FIG. 1, or a heater for adjusting the temperature inside the head 50, or the like.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the print head 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The head driver 84 drives the actuators 58 of the heads of the treatment liquid and the respective colors 12S, 12C, 12M, 12Y, 12K on the basis of print data supplied from the print controller 80. The head driver 84 may be provided with a feedback control system for maintaining constant drive conditions for the print heads.

The dots formed by the treatment liquid are not required to have high resolution compared to the dots formed by the inks of respective colors, and therefore a mode is possible in which the dot data for the treatment liquid is different from the dot data for the inks of respective colors.

The image data to be printed is externally inputted through the communications interface 70, and is stored in the image memory 74. At this stage, RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M, Y. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to the head 50, ink is ejected from the head 50. By controlling ink ejection from the head 50 in synchronization with the movement velocity of the intermediate transfer body 16, an image is formed on the intermediate transfer body 16.

Various control programs are stored in a program storage unit 90, and the control programs are read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these storage media may also be provided. The program storage unit 90 may also be combined with a storage device (not shown) for storing operational parameters, or the like.

The print controller 80 controls the ultraviolet light source 18 via the light source driver 85. In other words, the light source driver 85 controls the on/off switching, the irradiation amount, the irradiation time, and the like, of the ultraviolet light source 18, in conjunction with the control of the conveyance of the intermediate transfer body 16, on the basis of control signals sent from the print controller 80 to the light source driver 85.

Description of Treatment Liquid and Ink

Next, the properties of the treatment liquid and the ink used in the present invention are described in detail. The presence or absence of depositing interference and the extent of depositing interference which depends on the properties of the treatment liquid and the properties of the ink were evaluated on the basis of the graininess of a solid image. The results of this evaluation are given below.

In this evaluation test, an IJET 1000 (manufactured by Microjet Co. Ltd.) was used as the treatment liquid and ink ejection apparatus, and a Personal IAS (compliant with ISO/IEC-compliant 13660, manufactured by Quality Engineering Associates, Inc.) was used as the apparatus for evaluating the graininess in a solid image. Silicone rubber was used as an ejection medium (corresponding to the intermediate transfer body 16). After the treatment liquid and ink were deposited in this order on the ejection medium, the treatment liquid and the ink were fixed (cured) on the ejection medium by irradiation of ultraviolet light, thereby obtaining each sample.

Preparation of Treatment Liquid

Eight different types of treatment liquid, from liquid 101 to liquid 108 below, were prepared, by mixing together and churning the compounds indicated below at normal temperature and then filtering them through a 5 μm membrane filter.

| | |
|---|---|
| Liquid 101 | |
| HDDA: polymerizable monomer | 85.0 wt % (weight percent) |
| DPCA60: polymerizable monomer | 9.5 wt % |
| Irg1870: polymerization initiator | 5.0 wt % |
| F781F: surfactant | 0.5 wt % |
| Liquid 102 | |
| HDDA: polymerizable monomer | 20.0 wt % |
| BPE-10: polymerizable monomer | 74.0 wt % |
| Irg1870: polymerization initiator | 5.0 wt % |
| F781F: surfactant | 1.0 wt % |
| Liquid 103 | |
| HDDA: polymerizable monomer | 40.0 wt % |
| BPE-10: polymerizable monomer | 54.0 wt % |
| Irg1870: polymerization initiator | 5.0 wt % |
| F781F: surfactant | 1.0 wt % |
| Liquid 104 | |
| HDDA: polymerizable monomer | 45.0 wt % |
| BPE-10: polymerizable monomer | 49.0 wt % |
| Irg1870: polymerization initiator | 5.0 wt % |
| F781F: surfactant | 1.0 wt % |
| Liquid 105 | |
| HDDA: polymerizable monomer | 85.0 wt % |
| DPCA60: polymerizable monomer | 9.5 wt % |
| Irg1870: polymerization initiator | 5.0 wt % |
| F781F: surfactant | 0.5 wt % |
| Liquid 106 | |
| HDDA: polymerizable monomer | 85.5 wt % |
| DPCA60: polymerizable monomer | 9.5 wt % |
| Irg1870: polymerization initiator | 5.0 wt % |
| Liquid 107 | |
| HDDA: polymerizable monomer | 85.3 wt % |
| DPCA60: polymerizable monomer | 9.5 wt % |
| Irg1870: polymerization initiator | 5.0 wt % |
| F781F: surfactant | 0.2 wt % |
| Liquid 108 | |
| HDDA: polymerizable monomer | 84.0 wt % |
| DPCA60: polymerizable monomer | 9.0 wt % |
| Irg1870: polymerization initiator | 5.0 wt % |
| F781F: surfactant | 2.0 wt % |

Furthermore, three ink liquids were prepared, as liquid 201 to liquid 203 described below.

| | |
|---|---|
| Liquid 201 | |
| DPCA60 (Nippon Kayaku Co., Ltd.): monomer | 2.6 wt % |
| Phthalocyanine: coloring material | 5.0 wt % |

-continued

| | |
|---|---|
| sol32000: dispersant | 0.25 wt % |
| Irg1870: polymerization initiator | 6.0 wt % |
| Megafac F781F | 0.5 wt % |
| Remainder; 1,6-hexane diol diacrylate (HDDA manufactured by Daicel UCP, Co., Ltd.): monomer | |
| Liquid 202 | |
| DPCA60 (Nippon Kayaku Co., Ltd.): monomer | 2.6 wt % |
| Phthalocyanine: coloring material | 5.0 wt % |
| sol32000: dispersant | 0.25 wt % |
| Irg1870: polymerization initiator | 6.0 wt % |
| Megafac F781F | 1.0 wt % |
| Remainder; 1,6-hexane diol diacrylate (HDDA manufactured by Daicel UCP, Co., Ltd.): monomer | |
| Liquid 203 | |
| DPCA60 (Nippon Kayaku Co., Ltd.): monomer | 2.6 wt % |
| Phthalocyanine: coloring material | 5.0 wt % |
| sol32000: dispersant | 0.25 wt % |
| Irg1870: polymerization initiator | 6.0 wt % |
| Megafac F781F | 0.75 wt % |
| Remainder; 1,6-hexane diol diacrylate (HDDA manufactured by Daicel UCP, Co., Ltd.): monomer | |

In the judgment criteria of the evaluation tests, a case where the graininess of 1.0 or above is marked as "very poor", and this case indicates a state where density non-uniformity caused by depositing interference is clearly visible. Furthermore, a case where the graininess of 0.6 or above and less than 1.0 is marked as "poor", and this indicates a state where density non-uniformity is visible. The graininess of 0.4 or above and less than 0.6 is marked as "fair", and this indicates a state where slight density non-uniformity is visible.

In other words, the states indicated by "very poor", "poor", and "fair" in the evaluation judgment are states where density non-uniformity due to depositing interference is visible in each recorded image. On the other hand, the graininess of 0.3 or above and less than 0.4 is marked as "good", and the graininess of 0.3 or less is marked as "very good". These states indicate that a desirable recorded image is obtained in which no density non-uniformity is visible.

FIG. 8 is a table showing the evaluation results depending on the thickness t (see FIG. 2) of the treatment liquid. In the evaluation test of which the results are shown in FIG. 10, the liquid droplet volume of an ink droplet forming one dot (the ink ejected as a droplet in one ejection operation) was taken to be 70 pl. Furthermore, the liquid 101 described above was used as the treatment liquid, and the liquids 201 and 202 were used as the ink.

As shown in FIG. 8, when the thickness t of the treatment liquid (liquid 101) on the ejection medium is in the range of 0 μm (no film) to 1.5 μm, then the judgement for both liquid 201 and liquid 202 was "very poor", "poor", or "fair", which indicates a state where density non-uniformity is visible in the image formed on the ejection medium.

On the other hand, if the thickness t of the treatment liquid on the ejection medium was 1.6 μm, 2 μm, 5 μm, or 10 μm, then the judgment for both liquid 201 and liquid 202 was "very good" or "good"; and if the thickness t of the treatment liquid on the ejection medium was 1.6 μm or above, then depositing interference did not occur between the ink droplets and hence a desirable image containing no visible image deterioration due to density non-uniformity, and the like, could be obtained. In other words, the desirable thickness t of the treatment liquid is 1.6 μm or above.

The thickness t of the treatment liquid tends to depend also on the ink droplet volume (if the ink droplet volume is greater, then it is preferable that the thickness of the treatment liquid (treatment liquid volume) should also be greater). In the ink droplet volume range of several picoliters to several tens of picoliters, which is included in the range of application of the present invention, it is possible to obtain a desirable image if the thickness t of the treatment liquid is 1.6 μm or above.

The thickness t of the treatment liquid which produces particularly desirable results was 10 μm in the case of both liquid 201 and liquid 202. Therefore, more desirably, the thickness t of the treatment liquid is 10 μm or above.

Furthermore, in the present evaluation test, the liquid 101 was used as one embodiment of the treatment liquid. Similar results could be obtained by using the other treatment liquids described above (liquid 102 to liquid 108).

FIG. 9 is a diagram showing evaluation results depending on the change in the viscosity of the treatment liquid at a temperature of 25° C. In the evaluation test whose evaluation results are shown in FIG. 9, the treatment liquid was deposited onto the ejection medium to a thickness of 10 μm, and the ink was deposited thereon. For the treatment liquid, liquid 101 to liquid 105 were used, and for the ink, liquid 201 and liquid 202 were used.

In cases where the liquid 103 having a viscosity of 482 mPa·s at 25° C. and the liquid 104 having a viscosity of 310 mPa·s at 25° C. were used, if either the liquid 201 or the liquid 202 was used as the ink, then the judgment was "poor" or "fair", which means that density non-uniformities were visible in each recorded image.

On the other hand, in cases where the liquid 101 having a viscosity of 15 mPa·s at 25° C., the liquid 104 having a viscosity of 287 mPa·s at 25° C. or the liquid 105 having a viscosity of 48 mPa·s at 25° C. was used, the judgment was "very good" or "good", even if the liquid 201 or the liquid 202 was used as the ink. Therefore, when the treatment liquid having a viscosity of 15.3 mPa·s to 287 mPa·s is used, it is possible to obtain a desirable image which contains no visible density non-uniformities.

In other words, the desirable viscosity range of the treatment liquid is 15 mPa·s or above and 300 mPa·s or below. The viscosity of the treatment liquid at which particularly desirable results are obtained is 15.3 mpa·s, and therefore, it is preferable for the viscosity of the treatment liquid to be lower within the desirable range of the treatment liquid viscosity described above. It is inferred that similar beneficial effects can also be obtained if the liquid 203 is used as the ink.

FIG. 10 is a diagram showing evaluation results for cases where the relationship between the dynamic surface tension $\gamma\mathbf{1}$ of the treatment liquid at a surface age of 0.1 sec and the dynamic surface tension $\gamma\mathbf{2}$ of the ink at a surface age of 0.1 sec is varied. Dynamic surface tensions were determined by the Bubble Pressure Tensiometer BP2 manufactured by Krüss GmbH. Static surface tensions were determined by the surface tensiometer CBVP-Z manufactured by Kyowa Interface Science Co., Ltd. The theory of the bubble pressure method can be found, for example, on the Internet (URL: http://www.kruss.info/techniques/bubble_pressure_e.html). In the evaluation test whose results are shown in FIG. 10, liquid 101 and liquids 106 to 108 were used as the treatment liquid, and liquids 201 to 203 were used as the ink.

For any of the combinations of the treatment liquid and the ink, in cases where the relationship between the dynamic surface tension of the treatment liquid, $\gamma\mathbf{1}$, and the dynamic surface tension of the ink, $\gamma\mathbf{2}$, satisfies the relationship $\gamma\mathbf{1}<\gamma\mathbf{2}$, the judgment is "very good", and hence a desirable image without any visible density non-uniformities could be obtained.

Combinations of the treatment liquid and the ink which yield particularly preferable results were: a combination of liquid 101 and any of liquids 201 to 203; a combination of liquid 107 and liquid 201; and a combination of liquid 108 and any of liquids 201 to 203. In other words, in addition to the thickness conditions of the treatment liquid 30 described with reference to FIG. 8 and the viscosity conditions of the treatment liquid 30 described with reference to FIG. 9, by satisfying the relationship $\gamma 1<\gamma 2$ between the dynamic surface tension $\gamma 1$ of the treatment liquid 30 and the dynamic surface tension $\gamma 2$ of the ink 32 as described in FIG. 10, it is possible to prevent depositing interference of the ink 32 more effectively.

Furthermore, it is more desirable that there is a large differential between the surface tension $\gamma 1$ of the treatment liquid and the surface tension $\gamma 2$ of the ink. In the present evaluation test, silicone rubber was used for the ejection medium, but similar effects can also be obtained in cases where a glass material or a stainless steel material is used for the ejection medium.

FIG. 11 is a diagram showing the results of an evaluation test carried out with respect to the viscosity of the ink on the intermediate transfer body. In the evaluation test whose results are shown in FIG. 11, states of different ink viscosities were created by radiating ultraviolet light under prescribed conditions onto ink droplets deposited on the intermediate transfer body, and the ink transfer rate when transferring the ink from the intermediate transfer body to the PET film was calculated by measuring the weight. The viscosity value of the ink droplets was obtained by accumulating the ink that had received ultraviolet light irradiation under the same conditions and then measuring the viscosity thereof.

In the test results shown in FIG. 11, the transfer rate of less than 90% is marked as "very poor", the transfer rate of 90% or above and less than 95% is marked as "poor", the transfer rate of 95% or above and less than 99% is marked as "fair", the transfer rate of 99% or above and less than 99.9% is marked as "good", and the transfer rate of 99.9% or above is marked as "very good".

As shown in FIG. 11, if the ink viscosity was 3020 mPa·s or less, then the transfer rate became less than 95%, and visible image deterioration occurred in the image transferred onto the PET film. On the other hand, by setting the ink viscosity to be 5000 mpa·s (4870 mPa·s) nor above, the transfer rate of the ink becomes 95% or above, and there was no visible image deterioration in the image transferred to the PET film.

In other words, a desirable mode is one in which the liquid (i.e., the liquid which is to be transferred) forming an image on the intermediate transfer body 16 has a viscosity of 5000 mPa·s or above when the image is transferred from the intermediate transfer body 16 to the recording medium 20.

In the inkjet recording apparatus 10 having the composition described above, the treatment liquid 30 having a viscosity of 15 mPa·s to 300 mPa·s at 25° C. is deposited on a prescribed image forming region on the intermediate transfer body 16, and the ink 32 is then ejected in the form of droplets onto the image forming region on which the treatment liquid 30 having the thickness t of 1.6 μm or above is deposited. Consequently, a desirable image without depositing interference and beading is formed on the image forming region of the intermediate transfer body 16.

Moreover, since a composition is adopted in which the image is transferred to the recording medium 20 after the image is fixed provisionally on the intermediate transfer body 16, then it is possible to obtain a satisfactory image which is free of ink bleeding and image distortion.

Second Embodiment

Figure 12:
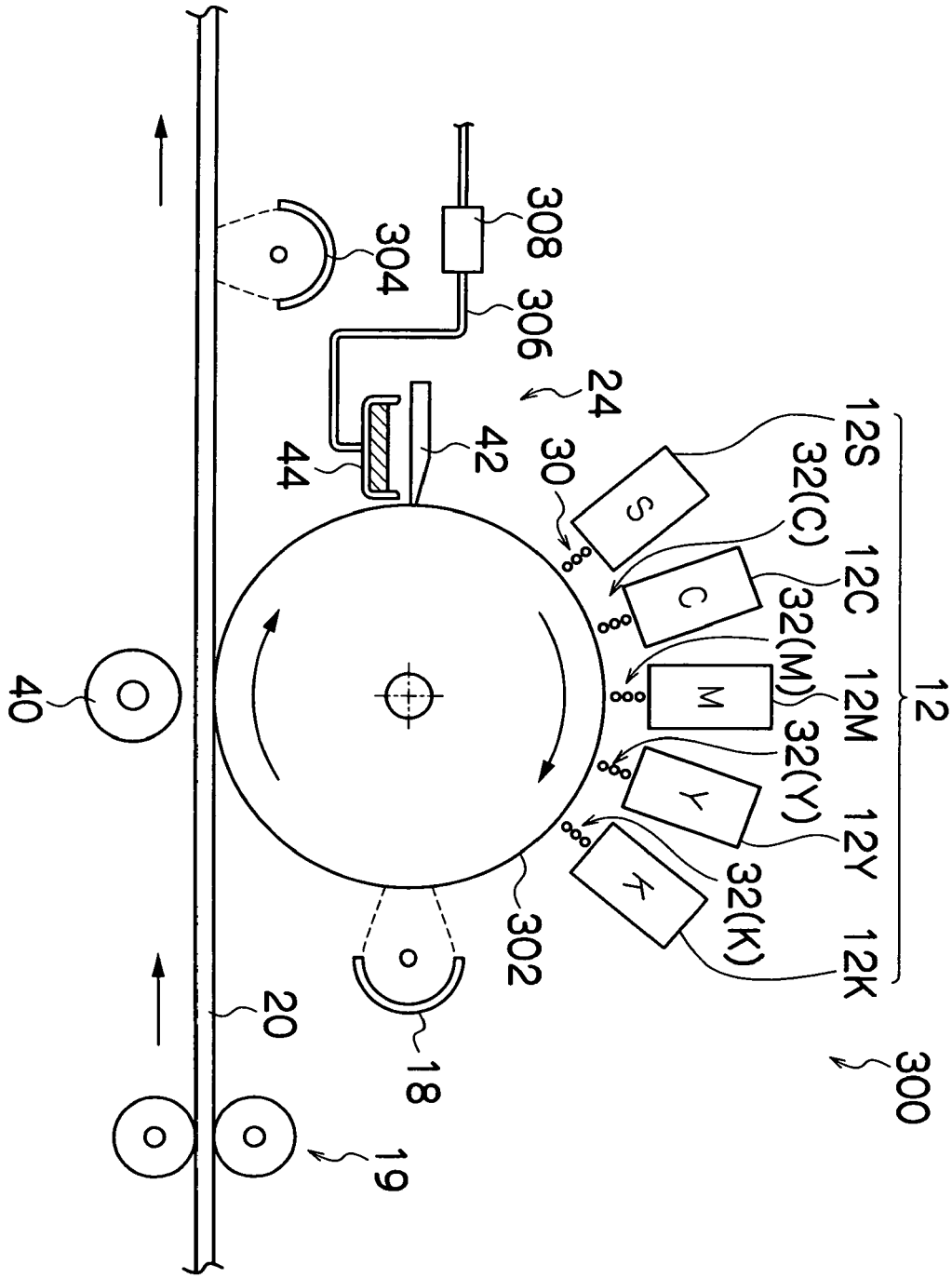
FIG. 12 is a general compositional diagram of an inkjet recording apparatus according to a second embodiment of the present invention.

Next, a second embodiment of the present invention is described. FIG. 12 is a general schematic drawing of an inkjet recording apparatus 300 according to the second embodiment. Items which are the same as or similar to those in the first embodiment described above are labeled with the same or similar reference numerals and description thereof is omitted here.

As shown in FIG. 12, the intermediate transfer body 302 has a hollow round cylindrical shape. In a mode where a drum-shaped member of this kind is used for the intermediate transfer body 302, a beneficial effect is obtained in that the throw distance (i.e., the distance between the intermediate transfer body 16 and the nozzle forming surface of each of the heads 12S, 12C, 12M, 12Y, 12K) is stabilized.

Furthermore, in the mode shown in FIG. 12, an ultraviolet light source 304 for fully fixing, on the recording medium 20, the image that has been transferred thereto is also provided. The ultraviolet light source 304 used may have the same specifications as the ultraviolet light source 18 for provisionally solidifying the ink droplets deposited on the intermediate transfer body 302; however, since the applied energy required in order to fix the image onto the recording medium 20 is greater than the applied energy used in provisionally solidifying the image on the intermediate transfer body 302, then it is preferable to use the ultraviolet light source 304 having a greater energy application capacity than that of the ultraviolet light source 18.

In the mode shown in FIG. 12, a flow channel 306 connecting to a recovery unit 44 which recovers the residual treatment liquid and the residual ink removed from the intermediate transfer body 302, and a recycling unit 308 for recycling the residual treatment liquid and the residual ink, are provided. By recycling the residual treatment liquid and the residual ink in this way, it is possible to reuse the ultraviolet-curable polymerizable compound, which is highly expensive, thereby contributing to reducing the running costs of the inkjet recording apparatus 300.

In also the mode shown in FIG. 1, it is desirable to provide the ultraviolet light source 304 shown in FIG. 12 which fully cures the image transferred to the recording medium 20, and the recycling unit 308 which recycles the residual treatment liquid and the residual ink.

Third Embodiment

Figure 13:
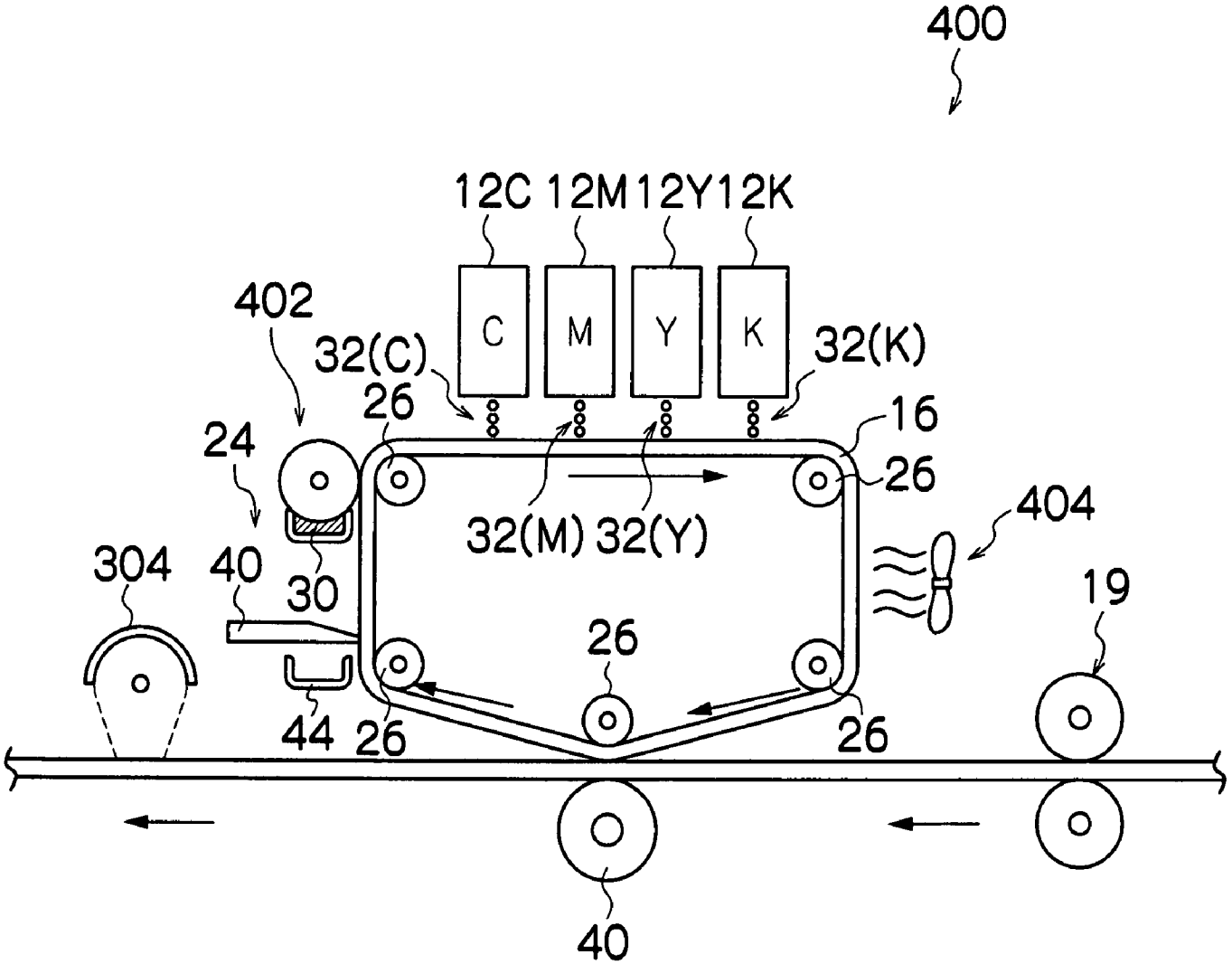
FIG. 13 is a general compositional diagram of an inkjet recording apparatus according to a third embodiment of the present invention.

Next, a third embodiment of the present invention is described. FIG. 13 is a general schematic drawing showing an inkjet recording apparatus 400 according to the third embodiment. Items which are the same as or similar to those in the first and second embodiments described above are labeled with the same or similar reference numerals and description thereof is omitted here.

As shown in FIG. 13, the inkjet recording apparatus 400 comprises an application roller 402 forming a device which applies the treatment liquid 30 on the intermediate transfer body 16. In a mode where the treatment liquid 30 is applied by using the application roller 402, it is possible to simplify the composition of the device for depositing the treatment liquid on the intermediate transfer body 16 in comparison with a mode where droplets of the treatment liquid 30 are ejected by the treatment liquid head 12S shown in FIG. 1, and it is also possible to use treatment liquids having a higher viscosity in comparison with a mode using the head 12S. The viscosity range of the treatment liquid suitable for application by means of the application roller 402 is 5 mPa·s to 300 mPa·s, whereas in a mode using the head 12S, the suitable viscosity range of the treatment liquid is 5 mPa·s to 30 mPa·s.

Furthermore, in a mode using the application roller 402, it is possible to achieve a uniform film thickness of the treatment liquid 30 formed on the intermediate transfer body 16, by suitably adjusting the clearance and pressing force between the intermediate transfer body 16 and the application roller 402. On the other hand, in a mode using the treatment liquid head 12S as shown in FIG. 1, it is possible to deposit the treatment liquid 30 selectively in required locations (e.g., in the droplet ejection range of the ink 32, or in a range slightly broader than the droplet ejection range of the ink 32) only, and consequently the consumption of treatment liquid can be reduced.

In the embodiment shown in FIG. 13, a cooling fan 404 is provided as a device for provisionally solidifying the treatment liquid 30 and the ink 32 deposited on the intermediate transfer body 16 (for raising the viscosity of the treatment liquid 30 and the ink 32). A composition is adopted in which the treatment liquid 30 and the ink 32 deposited on the intermediate transfer body 16 are cooled by the cooling fan 404, thereby raising the viscosity. The viscosity of the treatment liquid 30 does not necessarily have to be raised, and it is sufficient to raise the viscosity of at least the ink 32 and provisionally solidify the ink 32 on the intermediate transfer body 16.

In a mode where the cooling fan 404 is used as a device for provisionally solidifying the ink 32 deposited on the intermediate transfer body 16, there is no need to add an ultraviolet-curable polymerizable compound in the treatment liquid 30, and the treatment liquid 30 contains a surfactant and other additives in this case. Furthermore, there is no need for the ink 32 to contain a polymerization initiator, and the ink 32 contains a pigment and other additives.

In the mode shown in FIG. 13, a cooling fan is depicted as an example of a device for provisionally solidifying the ink deposited on the intermediate transfer body 16, but it is also possible to increase the viscosity of the ink 32 (or the treatment liquid 30) by radiating an electron beam or by means of a chemical reaction between the treatment liquid 30 and the ink 32. The compositions of the treatment liquid 30 and the ink 32 are decided appropriately in accordance with the provisional solidifying device (viscosity raising device).

The treatment liquid 30 may or may not be solidified provisionally on the intermediate transfer body 16. In a mode where the treatment liquid 30 is not provisionally solidified on the intermediate transfer body 16, a desirable composition is one in which the treatment liquid 30 is removed before the transfer to the recording medium 20. One mode of a device for removing the treatment liquid 30 from the intermediate transfer body 16 is a device which removes the treatment liquid by a contact method using an absorbing roller containing non-woven cloth, or the like. Desirably, a composition is adopted in which the pressing force (absorbing force) of the absorbing roller can be adjusted in such a manner that the ink is not removed during the removal of the treatment liquid.

In the mode shown in FIG. 13, it is possible to adopt the drum-shaped intermediate transfer body 302 as shown in FIG. 12, and it is also possible to provide the recycling unit 308 which recycles the residual treatment liquid and the residual ink.

Adaptation Embodiment

Figure 14:
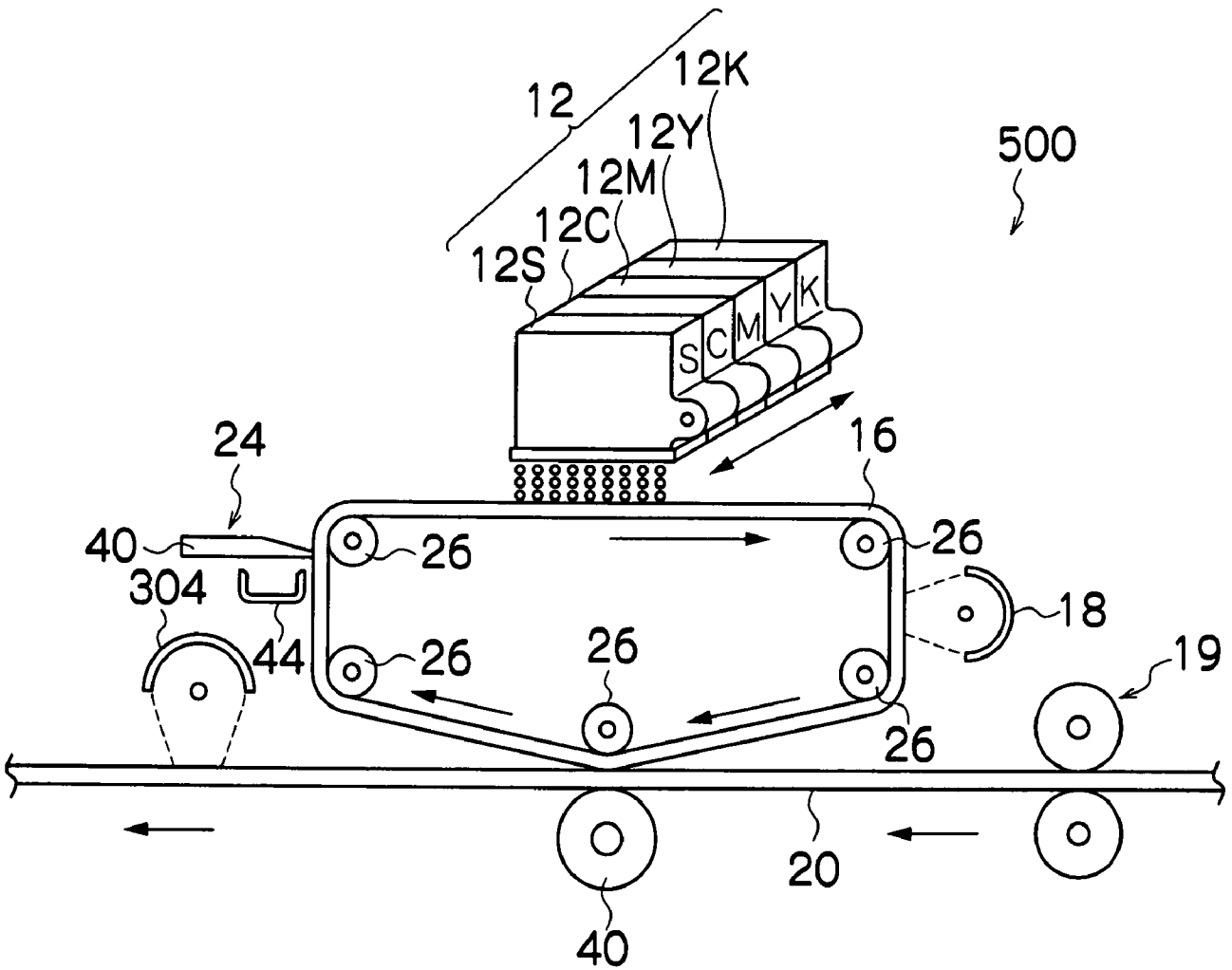
FIG. 14 is a general schematic drawing of an inkjet recording apparatus according to an adaptation embodiment of the present invention.

Next, variations of the first to third embodiments described above are described. In the inkjet recording apparatus 500 shown in FIG. 14, shuttle scanning heads in which each short head which does not reach the length of the intermediate transfer body 16 in terms of the breadthways direction performs printing in the breadthways direction of the intermediate transfer body 16 while moving in the breadthways direction, are used for the heads 12S, 12C, 12M, 12Y, 12K.

Short heads of this kind can be manufactured more easily than full line heads which correspond to the full width of the intermediate transfer body 16 such as that shown in FIG. 3, and hence manufacturing costs can be reduced.

Figure 15:
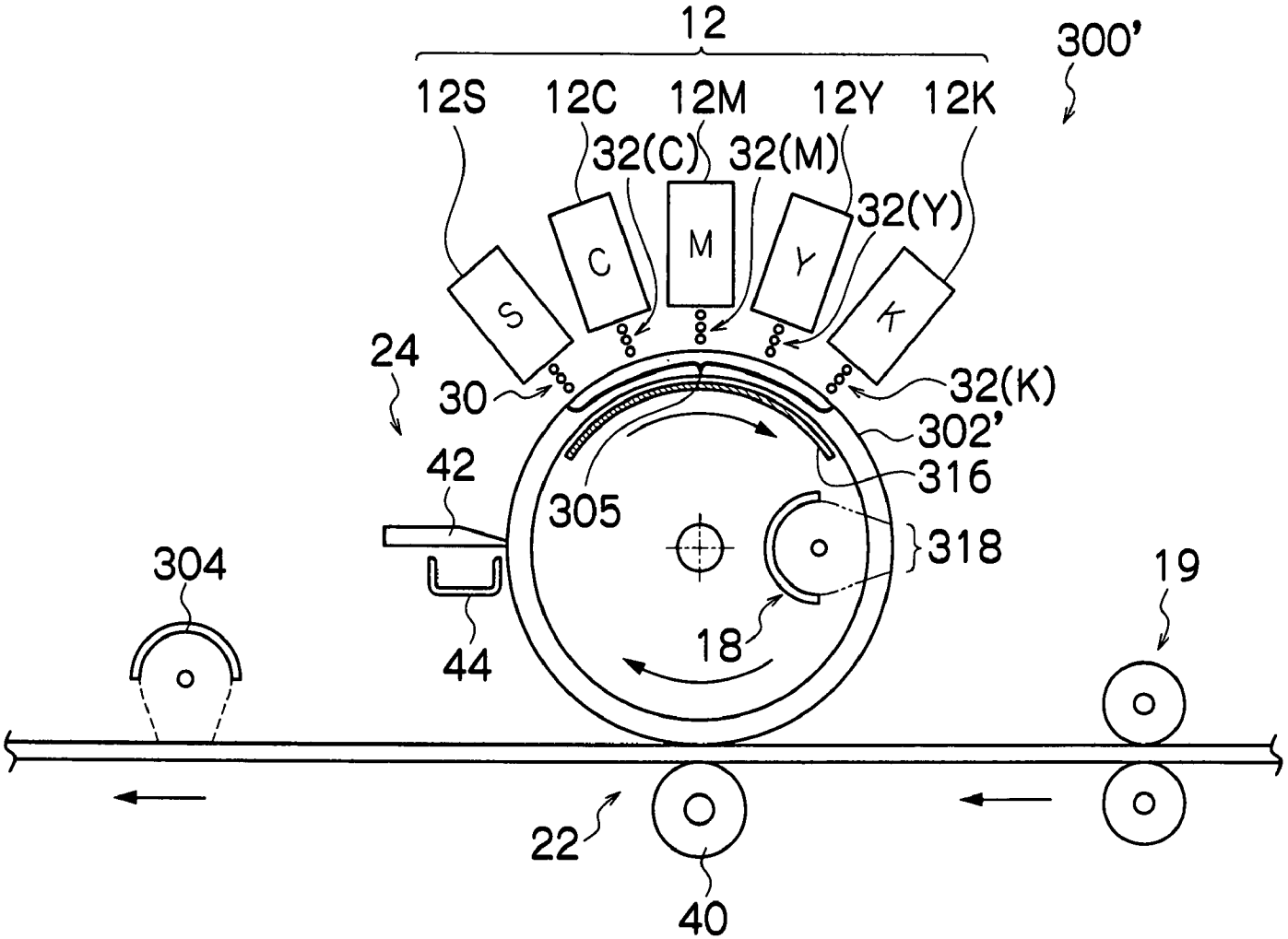
FIG. 15 is a general compositional diagram of an inkjet recording apparatus according to a further adaptation embodiment of the present invention.
Figure 16:
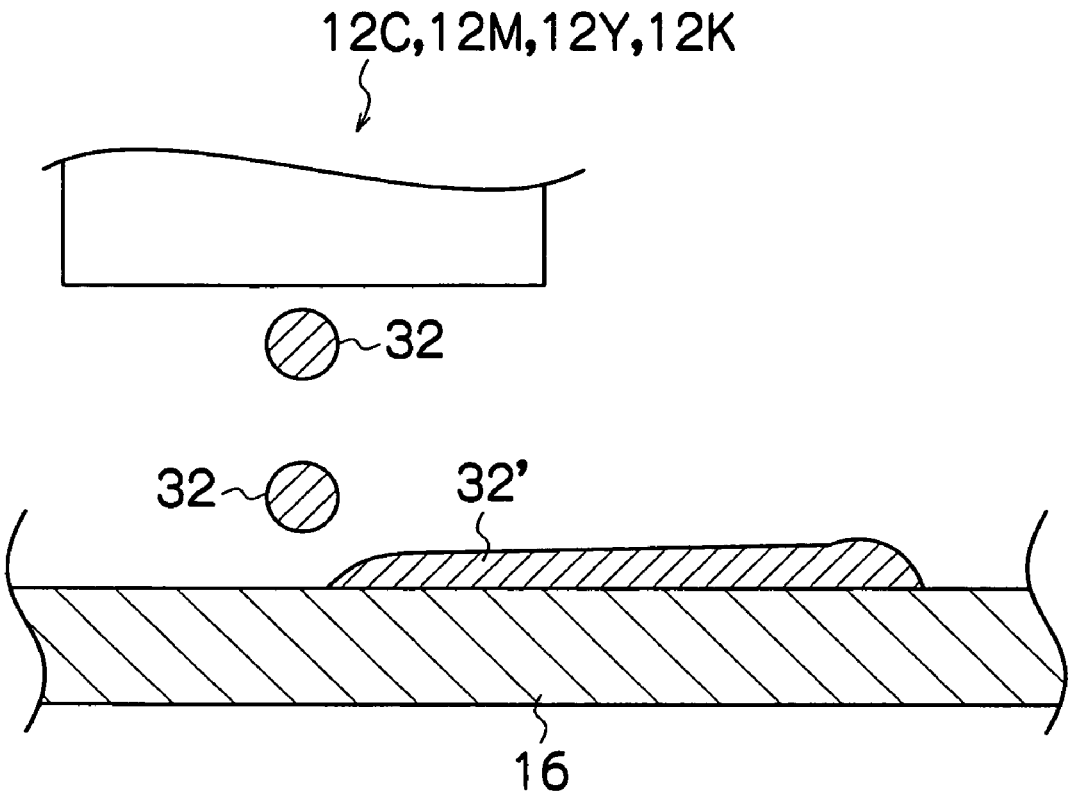
FIG. 16 is a diagram showing depositing interference in an inkjet recording apparatus in the related art.

Furthermore, the inkjet recording apparatus 300' shown in FIG. 15 has an intermediate transfer body 302' having a round cylindrical shape with a hollow structure, and an ultraviolet light source 18 is provided inside the intermediate transfer body 302'. In this way, it is composed in such a manner that ultraviolet light can be radiated from the ultraviolet light source toward the outside of the intermediate transfer body 302'.

Furthermore, the intermediate transfer body 302' is constituted by a transparent member (or a semi-transparent member) through which ultraviolet light can be transmitted, and it has a structure whereby the ultraviolet light can be radiated from the inner side of the intermediate transfer body 302' onto the droplets of the treatment liquid 30 and the inks 32 ejected from the heads 12S, 12C, 12M, 12Y, 12K. A shielding member 316 which blocks off the ultraviolet light is provided inside the intermediate transfer body 302' in a position corresponding to a droplet ejection region 305 in which droplets of the treatment liquid 30 and the inks 32 are ejected from the heads 12S, 12C, 12M, 12Y, 12K. In other words, the intermediate transfer body 302' has a light shielding structure which prevents ultraviolet light from being radiated onto the nozzle sections of the heads 12S, 12C, 12M, 12Y, 12K.

It is not necessary to compose the whole of the intermediate transfer body 16 from such a transparent member, and it is sufficient to compose at least the ultraviolet irradiation region 318 onto which ultraviolet light is radiated from the ultraviolet light source 18, from a transparent member (ultraviolet light-transmitting member). In a mode where a transparent member is used in only a portion of the intermediate transfer body 302', it is possible to omit the light shielding member 316 shown in FIG. 15. As members which can transmit ultraviolet light, for example, glass, transparent resin, and the like, can be used.

The foregoing embodiments describes the inkjet recording apparatus 10 for forming an image on the recording medium 20 by ejecting the inks from the nozzles provided in the print heads, but the scope of application of the present invention is not limited to this, and it may also be applied broadly to image forming apparatuses which form images (three-dimensional shapes) by means of a liquid other than ink, such as resist, or to liquid ejection apparatuses, such as dispensers, which eject a chemical liquid, water, and the like, from nozzles (ejection holes).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

an intermediate transfer body;

a liquid adhesion device which provides a first liquid having a viscosity not less than 15 mPa·s and not greater than 300 mPa·s at 25° C., on the intermediate transfer body;

a droplet ejection device which ejects a second liquid containing a coloring material onto a region of the intermediate transfer body where the first liquid is provided by the liquid adhesion device, in a state where the first liquid on the intermediate transfer body has a thickness not less than 1.6 μm;

a viscosity raising device which raises a viscosity of the second liquid on the intermediate transfer body; and a transfer device which transfers an image including dots of the second liquid formed on the intermediate transfer body, onto a recording medium, wherein a relationship between a dynamic surface tension $\gamma_1$ at a surface age of 0.1 sec of the first liquid and a dynamic surface tension $\gamma_2$ at a surface age of 0.1 sec of the second liquid satisfies the following relationship: $\gamma_1<\gamma_2$.

2. The image forming apparatus as defined in claim 1, wherein the droplet ejection device comprises a full line liquid ejection head having a nozzle row in which nozzles ejecting the second liquid are arranged through a length corresponding to a breadth of the intermediate transfer body.

3. The image forming apparatus as defined in claim 1, wherein:

the second liquid contains a radiation-curable polymerizable compound; and the viscosity raising device comprises a radiation irradiation device.

4. The image forming apparatus as defined in claim 1, wherein:

the second liquid contains a radiation-curable polymerizable compound;

the intermediate transfer body has a hollow round cylindrical shape;

the viscosity raising device comprises a radiation irradiation device which is arranged inside the intermediate transfer body and which irradiates the second liquid on the intermediate transfer body with a radiation; and at least a portion of the intermediate transfer body which is irradiated with the radiation by the radiation irradiation device is composed of a member which transmits the radiation.

5. The image forming apparatus as defined in claim 1, wherein:

the second liquid contains an ultraviolet-curable polymerizable compound;

at least one of the first liquid and the second liquid contains a polymerization initiator; and the viscosity raising device comprises an ultraviolet light irradiation device.

6. The image forming apparatus as defined in claim 1, wherein the viscosity raising device raises the viscosity of the second liquid on the intermediate transfer body to not less than 5000 mPa·s.

7. The image forming apparatus as defined in claim 1, further comprising a main curing device which performs main curing of the image on the recording medium.

8. The image forming apparatus as defined in claim 1, wherein the transfer device comprises a heating device which heats the dots of the second liquid to a temperature not less than a glass transition temperature of the second liquid.

9. The image forming apparatus as defined in claim 1, wherein:

the dynamic surface tension $\gamma_1$ at the surface age of 0.1 sec of the first liquid is not more than 29 mN/m; and the dynamic surface tension $\gamma_2$ at the surface age of 0.1 sec of the second liquid is not less than 31.3 mN/m and not more than 34.8 mN/m.

10. An image forming method for forming an image on an intermediate transfer body and transferring the image from the intermediate transfer body onto a recording medium, the image forming method including the steps of:

providing a first liquid having a viscosity not less than 15 mPa·s and not greater than 300 mPa·s at 25° C., on the intermediate transfer body;

ejecting a second liquid containing a coloring material onto a region of the intermediate transfer body where the first liquid is provided, in a state where the first liquid has a thickness not less than 1.6 μm on the intermediate transfer body;

raising a viscosity of the second liquid on the intermediate transfer body; and transferring the image including dots of the second liquid formed on the intermediate transfer body, onto the recording medium, wherein relationship between a dynamic surface tension $\gamma_1$ at a surface age of 0.1 sec of the first liquid and a dynamic surface tension $\gamma_1$, at a surface age of 0.1 sec of the second liquid satisfies a following relationship: $\gamma_1<\gamma_2$.

11. The image forming method as defined in claim 10, wherein:

the viscosity of the second liquid on the intermediate transfer body is raised by curing the second liquid; and the image is transferred onto the recording medium while the second liquid that has been cured is heated to a temperature not less than a glass transition temperature of the second liquid.

12. The image forming method as defined in claim 10, wherein the viscosity of the second liquid on the intermediate transfer body is raised to not less than 5000 mPa·s.

13. The image forming method as defined in claim 10, wherein:

the dynamic surface tension $\gamma_1$ at the surface age of 0.1 sec of the first liquid is not more than 29 mN/m; and the dynamic surface tension $\gamma_2$ at the surface age of 0.1 sec of the second liquid is not less than 31.3 mN/m and not more than 34.8 mN/m.

* * * * *